US010807361B2

(12) United States Patent
Takada

(10) Patent No.: US 10,807,361 B2
(45) Date of Patent: Oct. 20, 2020

(54) LIQUID JETTING HEAD AND LIQUID JETTING DEVICE

(71) Applicant: FUJIFILM Corporation, Tokyo (JP)

(72) Inventor: Norihisa Takada, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/445,230

(22) Filed: Jun. 19, 2019

(65) Prior Publication Data

US 2019/0299602 A1 Oct. 3, 2019

Related U.S. Application Data

(63) Continuation of application No. PCT/JP2018/000561, filed on Jan. 12, 2018.

(30) Foreign Application Priority Data

Jan. 19, 2017 (JP) ..... 2017-007747

(51) Int. Cl.
*B41J 2/045* (2006.01)
*B41J 2/165* (2006.01)
*B41J 2/01* (2006.01)

(52) U.S. Cl.
CPC ..... *B41J 2/04566* (2013.01); *B41J 2/01* (2013.01); *B41J 2/04586* (2013.01); *B41J 2/165* (2013.01); *B41J 2/16535* (2013.01)

(58) Field of Classification Search
CPC . B41J 2/04566; B41J 2/01; B41J 2/165; B41J 2/16535; B41J 2/04586; B41J 2/16526; B41J 2/16585; B41J 2/16508; B41J 2025/008; B41J 2002/16573; B41J 2002/1655
(Continued)

(56) References Cited

U.S. PATENT DOCUMENTS 6,315,379 B1 11/2001 Adams et al.
2007/0229611 A1* 10/2007 Nagashima ..... B41J 2/17563 347/84
(Continued)

FOREIGN PATENT DOCUMENTS

JP H102251461 10/1990
JP 2004181844 7/2004
(Continued)

OTHER PUBLICATIONS

"Office Action of Japan Counterpart Application", datedn Mar. 6, 2020, with English translation thereof, pp. 1-12.
(Continued)

*Primary Examiner* — Huan H Tran
*Assistant Examiner* — Alexander D Shenderov
(74) *Attorney, Agent, or Firm* — JCIPRNET

(57) ABSTRACT

Provided are a liquid jetting head and a liquid jetting device that prevent contamination of a humidity sensor. The liquid jetting head and the liquid jetting device include a nozzle that jets a liquid; a humidity sensor that is disposed further inside than the nozzle face where the nozzle is disposed; an air intake port that is disposed on the same plane as the nozzle face; a connection passage that allows the air intake port and the humidity sensor to communicate with each other; and a contamination preventing part that prevents contamination of the humidity sensor.

14 Claims, 20 Drawing Sheets

(58) Field of Classification Search
USPC ..... 347/17
See application file for complete search history.

(56) References Cited

U.S. PATENT DOCUMENTS

| | | | | |
|---|---|---|---|---|
| 2014/0210897 | A1* | 7/2014 | Koehler | B41J 2/04553 347/19 |
| 2016/0075138 | A1 | 3/2016 | Hashimoto | |

FOREIGN PATENT DOCUMENTS

| | | |
|---|---|---|
| JP | 2006224420 | 8/2006 |
| JP | 2007261204 | 10/2007 |
| JP | 2014019106 | 2/2014 |
| JP | 2015000517 | 1/2015 |
| JP | 2015102372 | 6/2015 |

OTHER PUBLICATIONS

"International Search Report (Form PCT/ISA/210) of PCT/JP2018/000561," dated Feb. 27, 2018, with English translation thereof, pp. 1-5.

"Written Opinion of the International Searching Authority (Form PCT/ISA/237) of PCT/JP2018/000561," dated Feb. 27, 2018, with English translation thereof, pp. 1-13.

* cited by examiner

LIQUID JETTING HEAD AND LIQUID JETTING DEVICE

CROSS-REFERENCE TO RELATED APPLICATIONS

The present application is a Continuation of PCT International Application No. PCT/JP2018/000561 filed on Jan. 12, 2018 claiming priority under 35 U.S.C § 119(a) to Japanese Patent Application No. 2017-007747 filed on Jan. 19, 2017. Each of the above applications is hereby expressly incorporated by reference, in their entirety, into the present application.

BACKGROUND OF THE INVENTION

1. Field of the Invention

The present invention relates to a liquid jetting head and a liquid jetting device, and particularly, to a liquid jetting head and a liquid jetting device that measure the humidity of a nozzle face.

2. Description of the Related Art

In liquid jetting heads that jet aqueous ink from nozzles, a jetting failure may be caused to degrade printing quality in a case where the ink inside a nozzle is dried. For this reason, jetting performance is maintained to prevent the degradation of the printing quality by installing a head maintenance function of performing dummy jetting periodically to remove viscosity-increased ink inside the nozzles or wiping a nozzle face contaminated with the ink after printing.

Additionally, in order to prevent the drying during printing pauses, there is suggested a method of sealing the nozzle face with a cap that holds a moisturizing liquid inside and maintaining the nozzles at high humidity due to evaporating moisture.

For example, JP2014-019106A discloses a technique in which a nozzle face is maintained at high humidity by disposing a cap for holding a moisturizing liquid in the portion of an elongated head facing nozzles at a narrow distance to drift the moisture evaporating from the moisturizing liquid around the head, and forming a substantially sealed space of a rubber seal member.

In the technique described in JP2014-019106A, the operation being normally executed is a premise for maintaining high humidity. Hence, in a case where the operation is not normal such that replenishment of the moisturizing liquid is insufficient, such that time passes, evaporation of the moisturizing liquid within the cap proceeds, and the water levels decreases, or such that the distance between the nozzle face and the cap is large, there is a possibility that the humidity of the nozzle face cannot be maintained. However, means for detecting a state where humidity has decreased is not disclosed.

With respect to this problem, JP-2006-224420A and JP-2004-181844A disclose a configuration in which a small-sized head is provided with a cap, and a humidity sensor is disposed near a nozzle face as means for detecting the ambient humidity inside the cap.

Additionally, JP2015-000517A describes that a nozzle face of an elongated head is provided with a humidity sensor.

SUMMARY OF THE INVENTION

In the configurations described in JP-2006-224420A and JP-2004-181844A, in a case where dummy jetting is performed in the liquid jetting head, there is a problem that ink mist may adhere to the humidity sensor and it is difficult to maintain stable output for a prolonged period of time.

Additionally, in a case where the nozzle face is wiped, there is also a problem that the humidity sensor may be contaminated with ink or a wiping liquid and normal humidity detection cannot be performed.

Also in JP2015-000517A, problems regarding the ink mist at the time of the dummy jetting and the ink contaminating and the wiping liquid contaminating at the time of wiping are not recognized.

The invention has been made in view of such circumstances, and an object thereof is to provide a liquid jetting head and a liquid jetting device that prevent contamination of a humidity sensor.

In order to achieve the above object, an aspect of a liquid jetting head comprises a nozzle that jets a liquid; a humidity sensor that is disposed further inside than the nozzle face where the nozzle is disposed; an air intake port that is disposed on the same plane as the nozzle face; a connection passage that allows the air intake port and the humidity sensor to communicate with each other; and a contamination preventing part that prevents contamination of the humidity sensor.

According to this aspect, the contamination of the humidity sensor can be prevented.

In addition, the inside of the nozzle face refers to a region on the liquid jetting head side with the nozzle face and an imaginary extending face of the nozzle face as a boundary. Additionally, the same plane as the nozzle face refers to a face including the nozzle face and the imaginary extending face of the nozzle face.

It is preferable that the liquid jetting head further comprises a plurality of the air intake ports; and a plurality of the connection passages that allow the plurality of air intake ports and the humidity sensor to communicate with each other, respectively. Accordingly, the connection passage from the air intake port to the humidity sensor does not become a closed path, and the responsiveness of the humidity sensor can be secured.

It is preferable that liquid-repelling treatment is performed on a member that forms the air intake port. This can prevent adhesion of the liquid to the member that forms the air intake port, and prevent entering of the liquid from the air intake port.

It is preferable that the humidity sensor is a temperature and humidity sensor that measures temperature and humidity. Accordingly, a temperature and a humidity equivalent to the temperature and the humidity of the nozzle face can be measured.

It is preferable that the humidity sensor is an electrostatic capacitive semiconductor sensor that detects a change in humidity as a change in electrostatic capacity between a pair of electrodes. Accordingly, the humidity equivalent to the humidity of the nozzle face can be appropriately measured while saving space.

It is preferable that the contamination preventing part is a nonlinear connection passage that connects the air intake port and the humidity sensor to each other by a bent path. This can appropriately prevent the contamination of the humidity sensor.

It is preferable that the contamination preventing part has an air introduction passage that communicates with the connection passage, and an air pump that pressurizes an inside of the connection passage via the air introduction passage. This can appropriately prevent the contamination of the humidity sensor.

In order to achieve the above object, an aspect of a liquid jetting device comprises a liquid jetting head having a nozzle that jets a liquid, a humidity sensor that is disposed further inside than the nozzle face where the nozzle is disposed, an air intake port that is disposed on the same plane as the nozzle face, a connection passage that allows the air intake port and the humidity sensor to communicate with each other, a contamination preventing part that prevents contamination of the humidity sensor, an air introduction passage that communicates with the connection passage, and an air pump that pressurizes an inside of the connection passage via the air introduction passage; and a wiping part that wipes the nozzle face.

According to this aspect, the contamination of the humidity sensor can be prevented.

It is preferable that the air pump starts the pressurizing of the connection passage before the wiping part wipes the nozzle face, and ends the pressurizing after the wiping part wipes the nozzle face. Accordingly, even in a case where the nozzle face is wiped, the contamination of the humidity sensor can be prevented, and the humidity equivalent to the humidity of the nozzle face can be appropriately detected.

In order to achieve the above object, an aspect of a liquid jetting device comprises a liquid jetting head having a nozzle that jets a liquid, a humidity sensor that is disposed further inside than the nozzle face where the nozzle is disposed, an air intake port that is disposed on the same plane as the nozzle face, a connection passage that allows the air intake port and the humidity sensor to communicate with each other, a contamination preventing part that prevents contamination of the humidity sensor, an air introduction passage that communicates with the connection passage, and an air pump that pressurizes an inside of the connection passage via the air introduction passage; a cap that holds a moisturizing liquid and covers the nozzle face; and a dummy jetting control unit that dummy-jets the liquid from the nozzle in a state where the nozzle face is covered with the cap.

According to this aspect, the contamination of the humidity sensor can be prevented.

It is preferable that the air pump starts the pressurizing of the connection passage before the dummy jetting control unit dummy-jets the liquid, and ends the pressurizing of the connection passage after the dummy jetting control unit dummy-jets the liquid. Accordingly, even in a case where the dummy jetting is performed, the contamination of the humidity sensor can be prevented, and the humidity equivalent to the humidity of the nozzle face can be appropriately detected.

It is preferable that the liquid jetting head has an elongated bar shape that extends in a first direction, the cap has a discharge port disposed on one end side of a bottom face in the first direction, and the bottom face is inclined downward in a vertical direction toward the discharge port, and the air intake port is disposed on the other end side opposite to the one end side in the first direction. Accordingly, even in a case where the liquid level of the cap has decreased, the humidity equivalent to the humidity of the nozzle face can be appropriately detected, and drying of the nozzle face can be prevented.

According to the invention, the contamination of the humidity sensor of the liquid jetting head can be prevented.

DESCRIPTION OF THE PREFERRED EMBODIMENTS

Preferred embodiments of the present invention will be described below in detail according to the accompanying drawings.

<First Embodiment>

[Configuration of Head]

Figure 1:
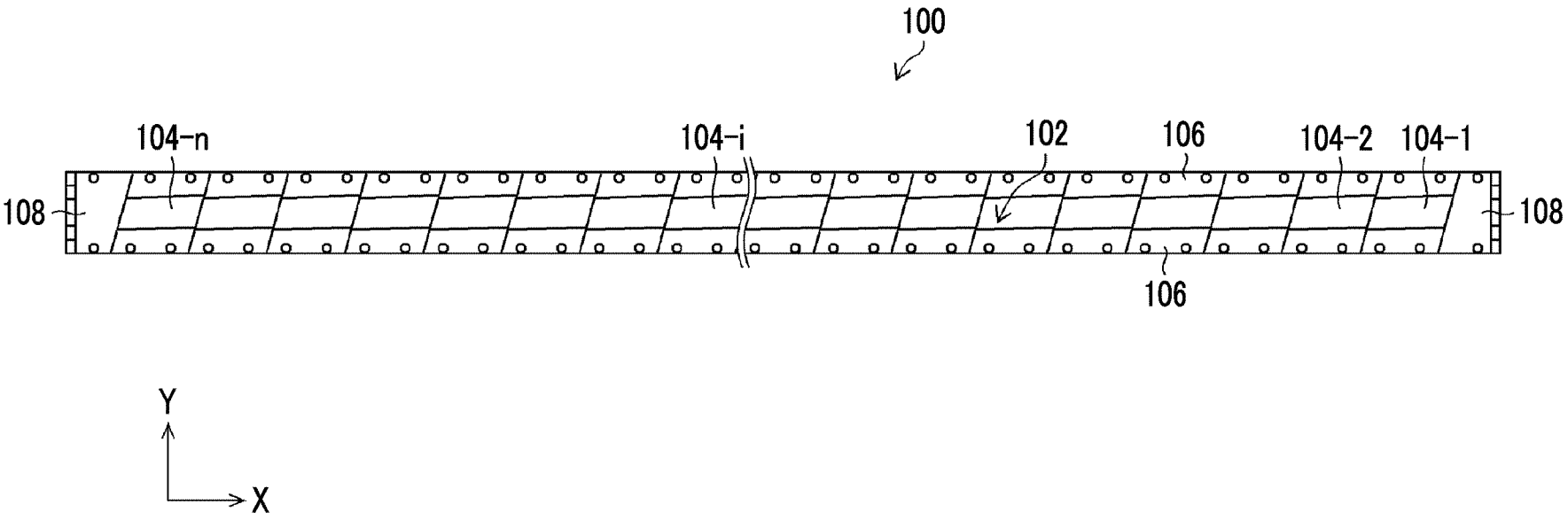
FIG. 1 is a plan view illustrating a structure example of an ink jet head.
Figure 2:
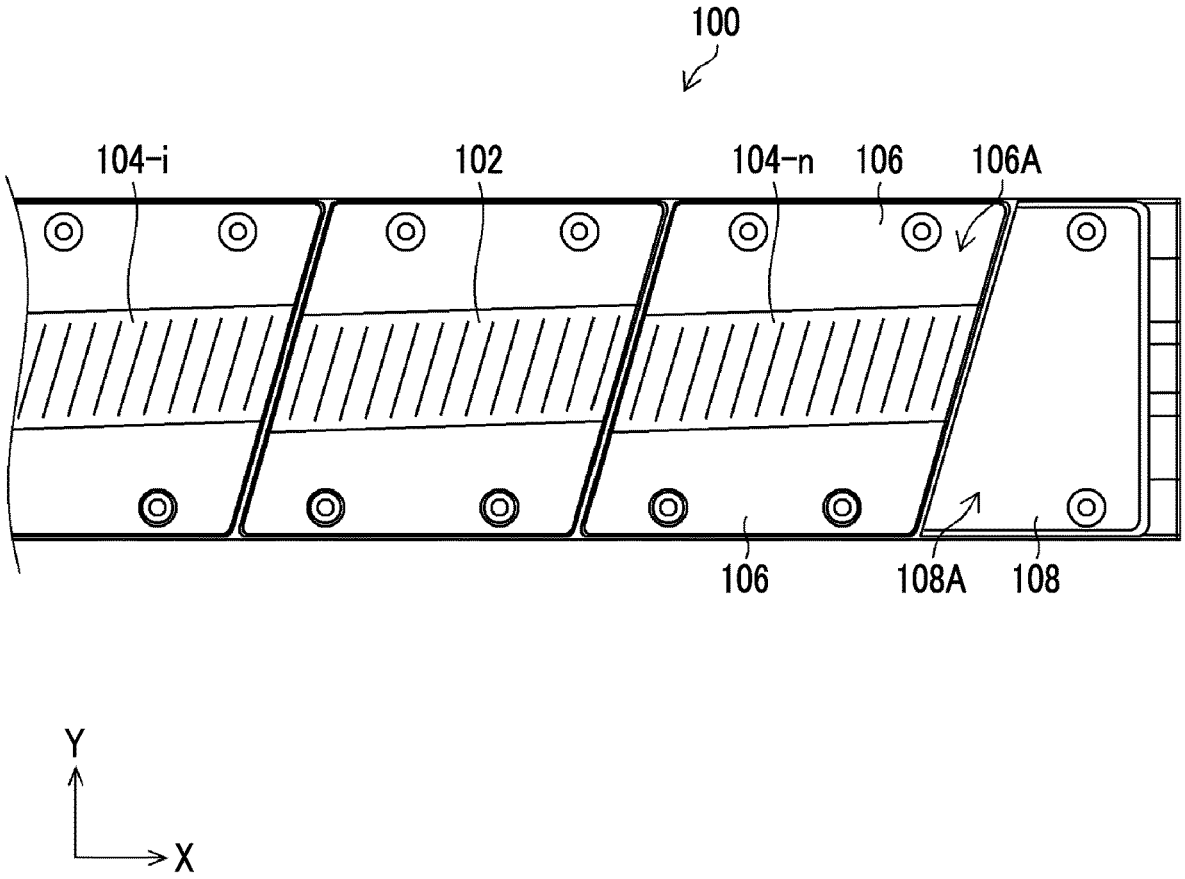
FIG. 2 is a partially enlarged view of FIG. 1.

FIG. 1 is a plan view illustrating a structure example of an ink jet head 100 (an example of a liquid jetting head, hereinafter described as a head 100) related to the present embodiment, and is a view of the head 100 as seen from a nozzle face 102 side. Additionally, FIG. 2 is a partially enlarged view of FIG. 1.

The head 100 has a structure in which n head modules 104-(i=1, 2, 3, . . . , and n) are connected to each other in an X direction (an example of a first direction), and has an elongated bar shape extending in the X direction.

Each head module 104-is supported by a head module supporting member 106 from both sides in a Y direction. Additionally, end caps 108 are mounted on both end parts of the head 100 in the X direction. The nozzle face 102 formed by each head module 104-*i*, a surface 106A of the head module supporting member 106, and a surface 108A of each end cap 108 form the same plane.

Since the structure of each head modules 104-is common, each head module 104-will be described below as a head module 104 unless otherwise specified.

Figure 3:
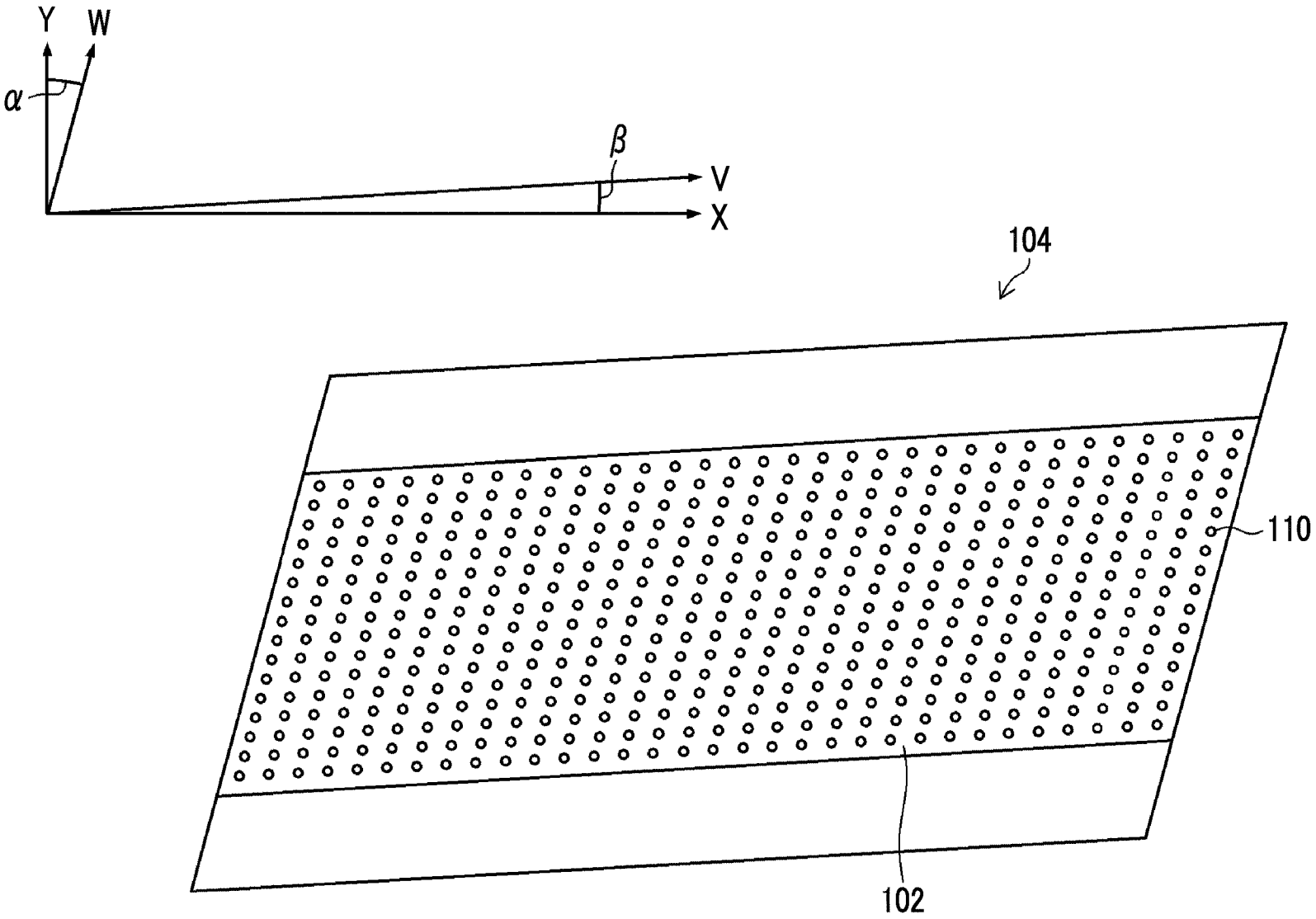
FIG. 3 is a plan view of a head module.

FIG. 3 is a plan view of the head module 104. As illustrated in this drawing, a plurality of nozzles 110 are disposed in the nozzle face 102 of the head module 104. Accordingly, the head 100 constitutes a full line type ink jet head in which a plurality of nozzles 110 are arranged in a matrix over a length corresponding to the total length, in the X direction, of a recording medium transported in the Y direction.

That is, the head module 104 is formed in a parallelogrammatic planar shape having an end face on the side of a long side extending in a V direction that has an inclination of an angle β with respect to the X direction, and an end face on the side of a short side extending in a W direction having an inclination of an angle α with respect to the Y direction. In the nozzle face 102, the plurality of nozzles 110 are arranged in a row direction that is the V direction and a column direction that is the W direction. In addition, the arrangement of the nozzles 110 is not limited to the aspect illustrated in FIG. 3, and the plurality of nozzles 110 may be arranged in the row direction that is the X direction and in a column direction that obliquely intersects the X direction.

In the head module 104 in which the nozzles 110 are arranged in a matrix, the nozzles 110 are arranged at equal intervals in the X direction in a projection nozzle row in which the nozzles 110 are projected so as to be aligned in the X direction. That is, the X direction is a substantial arrangement direction of the nozzles, and the intervals, in the X direction, of the nozzles 110 of the projection nozzle row becomes the recording resolution of the head 100 in the X direction.

Although illustration is omitted, the head module 104 comprises a pressure chamber that communicates with the nozzles 110, and a supply flow passage that communicates with the pressure chamber and a supply port. In a case where ink (an example of a liquid) is jetted from the nozzles 110, the pressure chamber is filled with ink via the supply port from the supply flow passage.

As an ink jetting method of the head 100, a piezoelectric method using deflection deformation of piezoelectric elements may be applied, or a thermal method using an ink film-boiling phenomenon may be applied. In the piezoelectric method, in a case where a driving voltage is applied to a piezoelectric element, the volume of the pressure chamber decreases depending on deflection deformation of the piezoelectric element, and the ink corresponding to the decrease in the volume of the pressure chamber is jetted from the nozzles 110.

Additionally, in the thermal method, bubbles are generated by heating the ink within the pressure chamber, and the ink corresponding to the volume of the pressure chamber is jetted from the nozzles 110.

[Humidity Detector]

The head 100 comprises a temperature and humidity detector 122 for measuring a humidity equivalent to humidity of the nozzle face 102.

Figure 4:
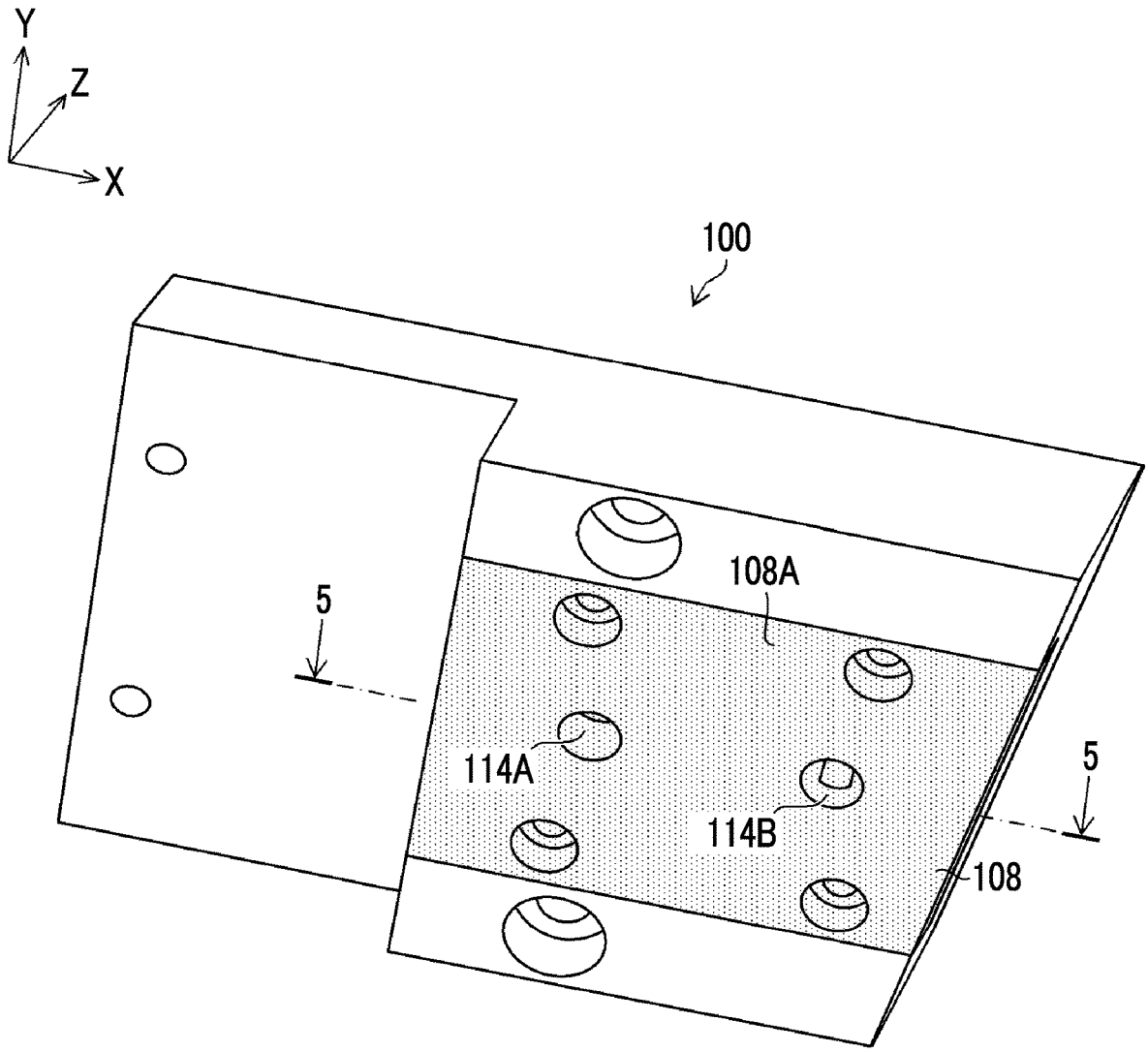
FIG. 4 is a perspective view in the vicinity of an end cap of a head.

FIG. 4 is a perspective view in the vicinity of the end cap 108 of the head 100. Two air intake ports 114A and 114B open to the surface 108A of the end cap 108 (an example of a component that forms air intake ports). That is, the air intake ports 114A and 114B are disposed on the same plane as the nozzle face 102 (refer to FIG. 2).

Figure 5:
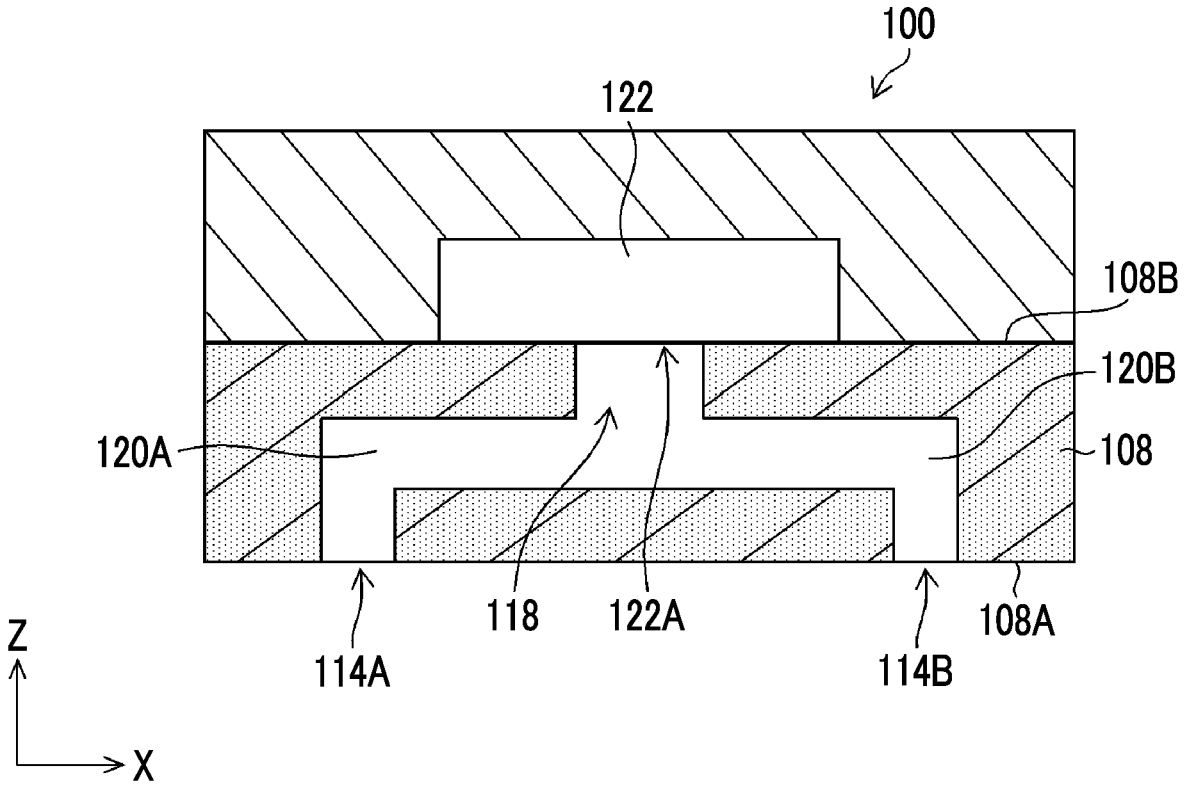
FIG. 5 is a conceptual diagram of cross-section 5-5 of FIG. 4.
Figure 6:
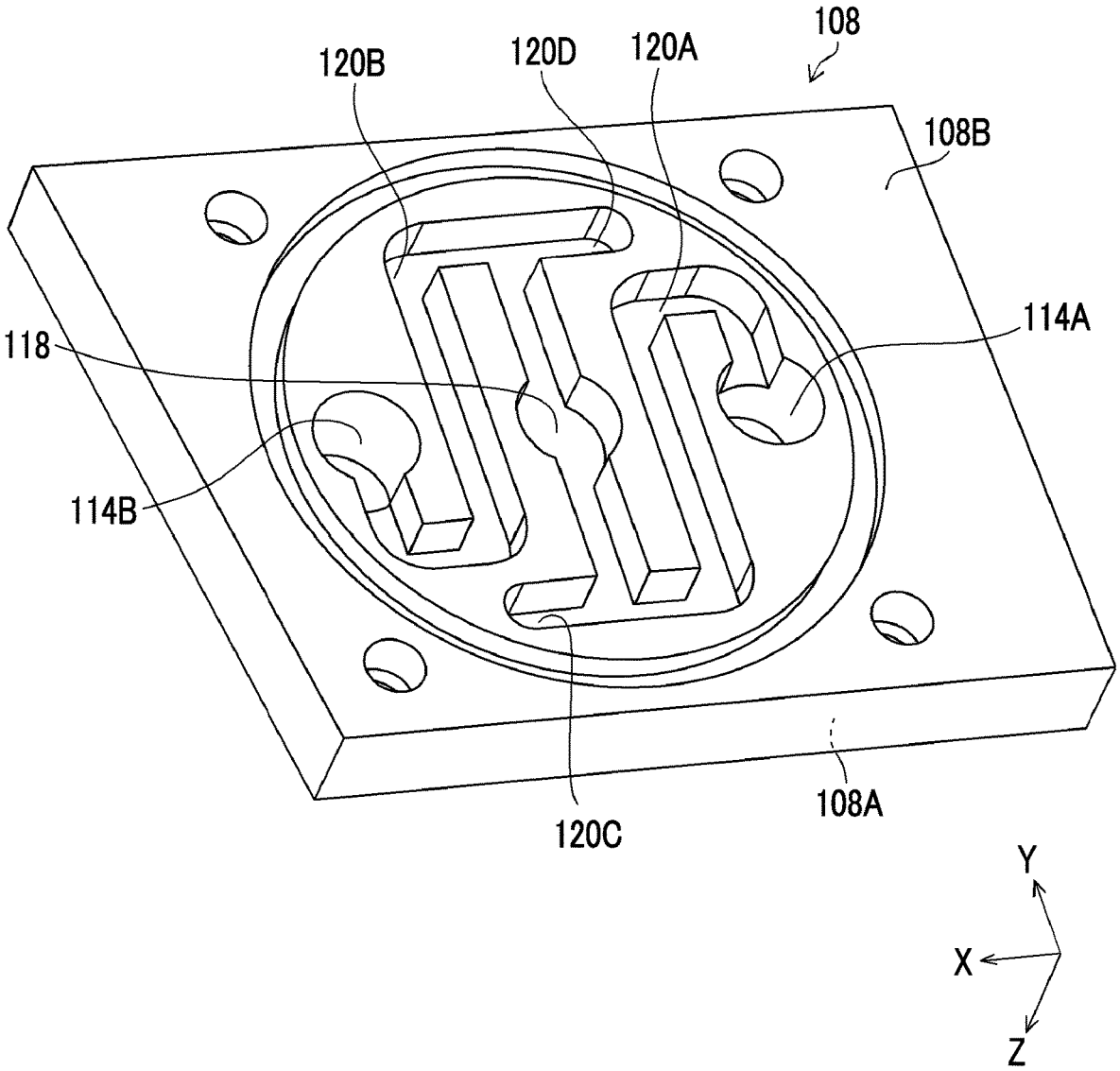
FIG. 6 is a perspective view of a back face side of the end cap.

FIG. 5 is a conceptual diagram of 5-5 cross-section of FIG. 4, and FIG. 6 is a perspective view on the side of the back face 108B that is a face opposite of the surface 108A of the end cap 108.

A recess part 118 is provided at a central part of the back face 108B of the end cap 108, and the temperature and humidity detector 122 is disposed in the recess part 118 such that a detection face 122A is directed to the back face 108B.

The temperature and humidity detector 122 is a humidity sensor that detects humidity. Here, a temperature and humidity sensor that can detect temperature and humidity simultaneously in the detection face 122A is used. A thermistor can be used as a temperature detecting sensor.

Additionally, an electrostatic capacitive semiconductor sensor can be used as a humidity detecting sensor. That is, the detection face 122A is a face where a specific dielectric constant changes due to adsorption of moisture, and the temperature and humidity detector 122 detects a change in humidity as a change in electrostatic capacity between a pair of electrodes.

In addition, as the humidity detecting sensor, the detection face 122A where impedance changes due to adsorption of moisture may be used, and humidity change may be detected as a change in impedance of the detection face 122A.

The air intake port 114A and the recess part 118 communicate with each other by way of a detector connection passage 120A, and the air intake port 114B and the recess part 118 communicate with each other by way of a detector connection passage 120B.

The detector connection passages 120A and 120B form labyrinth flow passages (an example of nonlinear connection passages) that connect the air intake ports 114A and 114B to the detection face 122A of the temperature and humidity detector 122 disposed in the recess part 118, respectively, by bent paths. Accordingly, the detector connection passages 120A and 120B function as a contamination preventing part that prevents the detection face 122A of the temperature and humidity detector 122 from being contaminated.

In an example illustrated in FIG. 6, the detector connection passages 120A and 120B are connected to each other as a flow passage in which the air intake ports 114A and 114B and the recess part 118 are bent four times in an XY plane, respectively.

Additionally, blind passage parts 120C and 120D are respectively formed in the detector connection passages 120A and 120B. In the present embodiment, it is not necessary to provide the blind passage parts 120C and 120D.

In this way, by disposing the temperature and humidity detector 122 inside the surface 108A of the end cap 108 and connecting the two air intake ports 114A and 114B disposed in the surface 108A to the detection faces 122A by the detector connection passages 120A and 120B, respectively, the humidity equivalent to the humidity of the nozzle face 102 that forms the same plane as the surface 108A of the end cap 108 can be measured.

In addition, the inside of the surface 108A of the end cap 108 refers to a region on the side of the end cap 108 (head 100 side) with the surface 108A and an imaginary extending face of the surface 108A as a boundary. Here, since the nozzle face 102 and the surface 108A form the same face, the inside of the surface 108A and the inside of the nozzle face 102 refers to the same region. That is, the temperature and humidity detector 122 is disposed further inside than the nozzle face 102.

Here, although the two detector connection passages 120A and 120B are provided and connected to each other from the surface 108A to the detection face 122A, it is also possible to adopt an aspect in which only one connection passages is provided is also possible. However, in a case where one connection passage is provided, the connection passage becomes a closed path reaching the detection face 122A. Therefore, replacement of air within the connection passage, particularly, in the vicinity of the temperature and humidity detector 122 is slow, and response of the temperature and humidity detection of the temperature and humidity detector 122 deteriorates. Hence, it is desirable to provide a plurality of connection passages.

[Overall Configuration of Ink Jet Recording Device]

Figure 7:
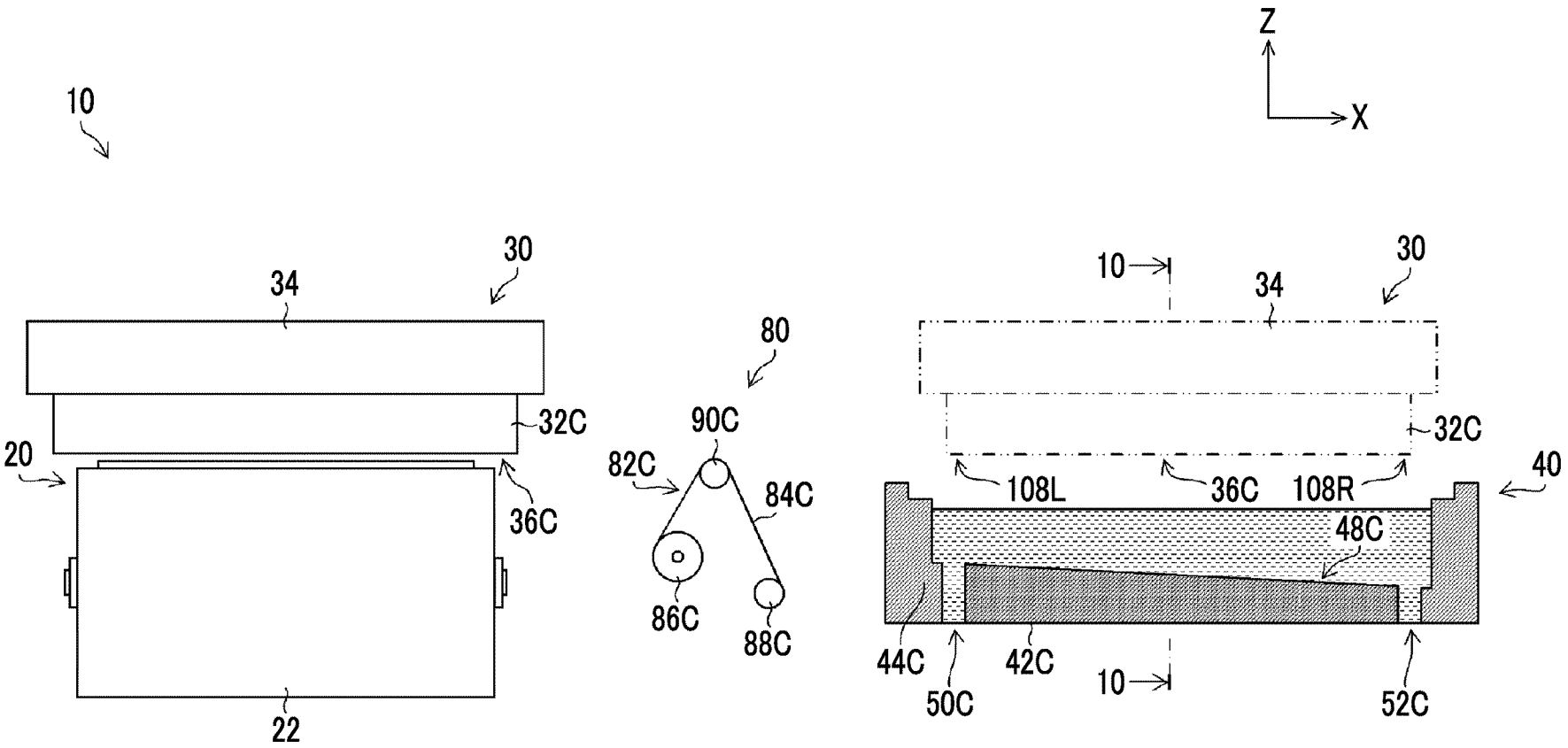
FIG. 7 is a front view illustrating the configuration of main parts of an ink jet recording device.
Figure 8:
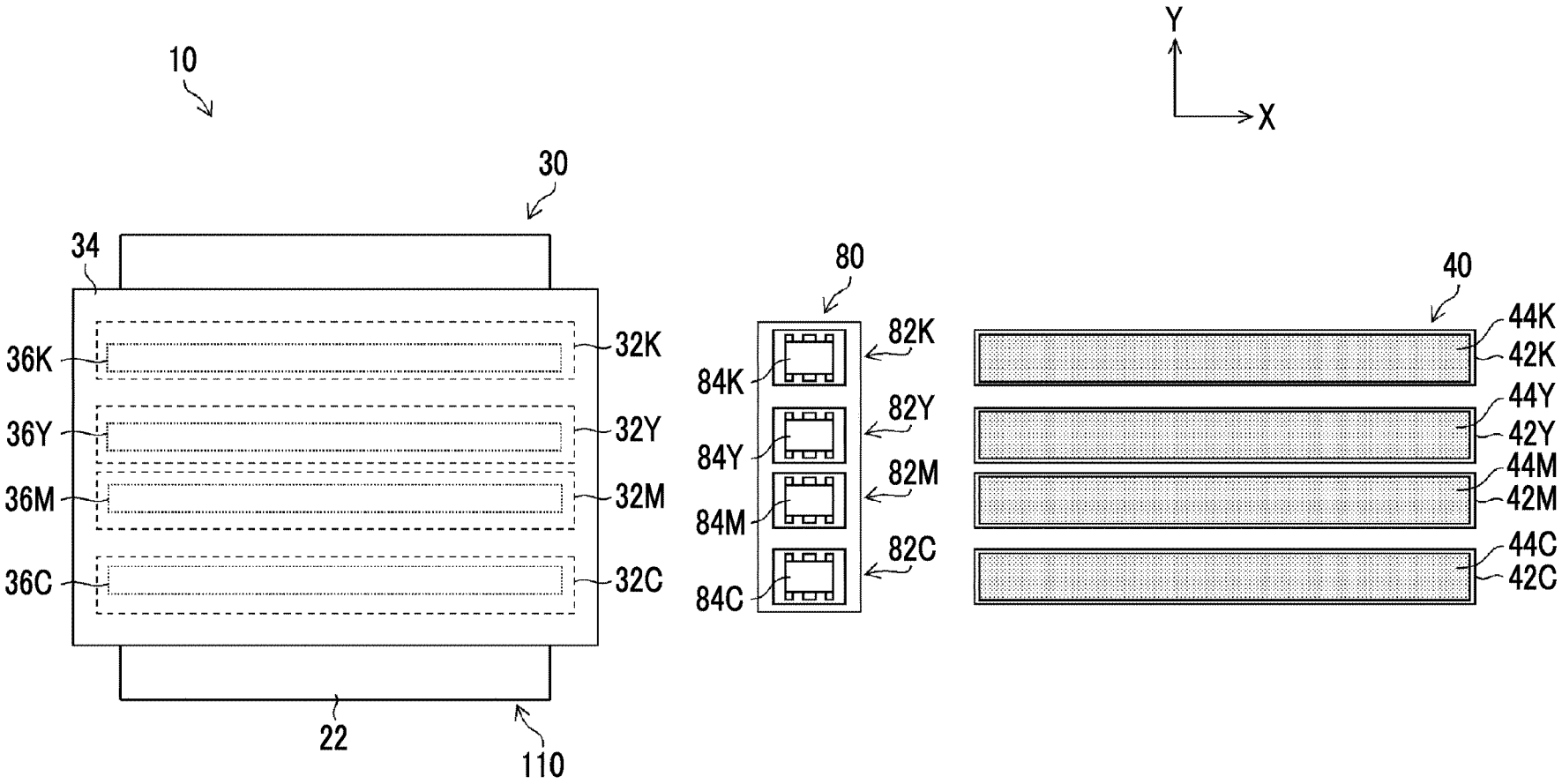
FIG. 8 is a plan view illustrating the configuration of main parts of the ink jet recording device.
Figure 9:
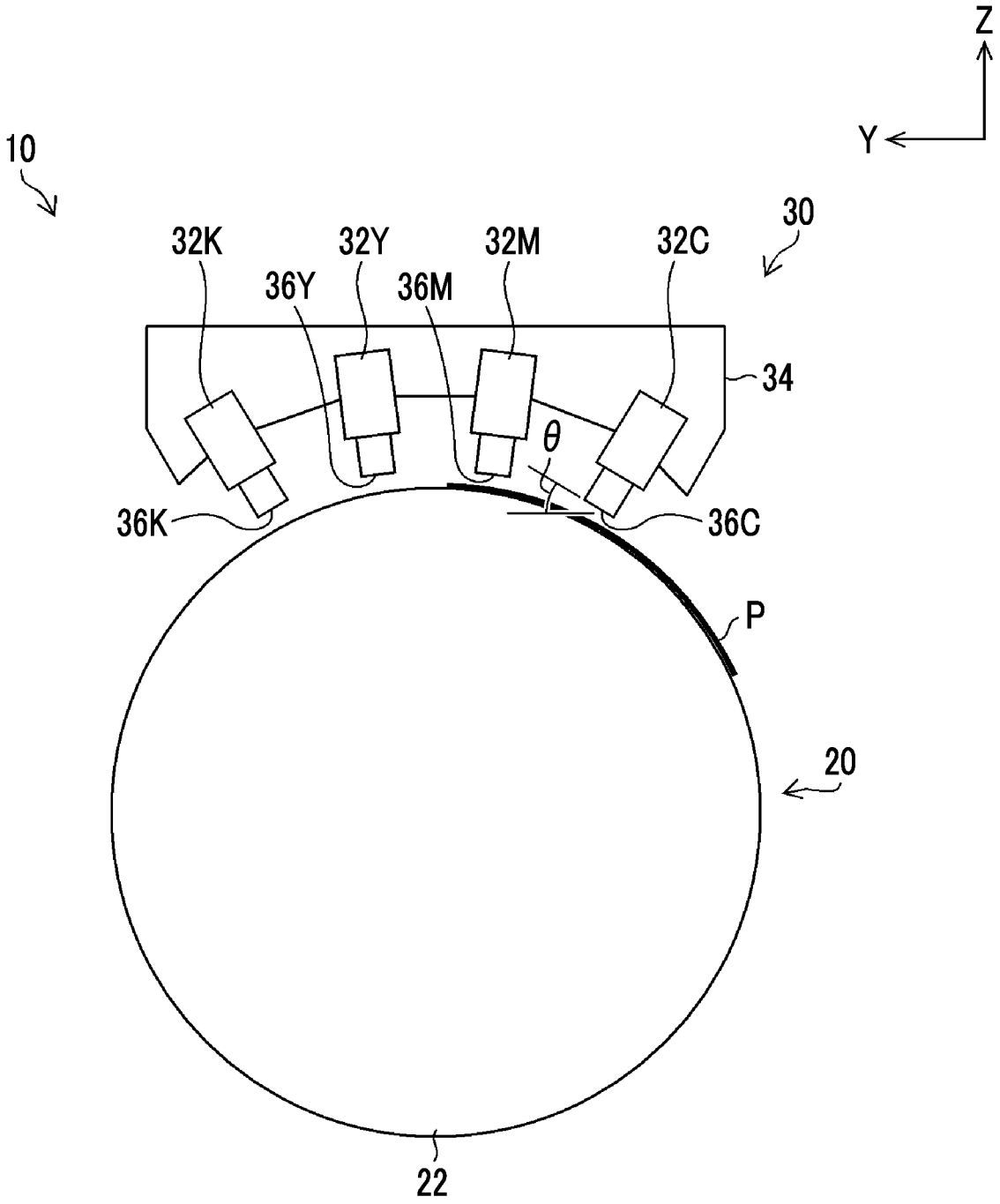
FIG. 9 is a side view illustrating the configuration of the main parts of the ink jet recording device.

FIGS. 7 to 9 are respectively a front view, a plan view, and a side view illustrating the configuration of main parts of an ink jet recording device 10 (an example of a liquid jetting device) related to the present embodiment. In addition, in FIG. 7, a cross-sectional view is illustrated in part.

The ink jet recording device 10 is a single pass type line printer, and is mainly constituted of a paper transport unit 20 that transports paper P that is a recording medium, a head unit 30 comprising heads 32C, 32M, 32Y, and 32K, a head moving mechanism 202 (refer to FIG. 16) that moves the head unit 30, a maintenance unit 40 that maintains the respective heads 32C, 32M, 32Y, and 32K provided in the head unit 30, and a nozzle face cleaning unit 80 that wipes and cleans nozzle faces of the respective heads 32C, 32M, 32Y, and 32K provided in the head unit 30.

The paper transport unit 20 is transporting means comprising a cylindrical transport drum 22 that is driven on a motor (not illustrated) and rotates with the center thereof as an axis. A gripper (not illustrated) is provided on an outer peripheral face of the transport drum 22, and the transport drum 22 transports the paper P while winding the paper P around the outer peripheral face, by gripping a leading edge of the paper P by the gripper to rotate the paper P.

Additionally, the transport drum 22 has a number of suction holes (not illustrated) in a constant pattern in the outer peripheral face thereof, and the paper P wound around the outer peripheral face of the transport drum 22 is transported while being suctioned and held on the outer peripheral face of the transport drum 22 by being suctioned from the suction holes. In this way, the transport drum 22 transports the paper P by a transport path that is inclined with respect to a horizontal plane.

The aforementioned head 100 is applied to each of the heads 32C, 32M, 32Y, and 32K. That is, the heads 32C, 32M, 32Y, and 32K are respectively line heads corresponding to the maximum paper width of the paper P serving as a target to be printed.

The respective heads 32C, 32M, 32Y, and 32K are respectively attached to a head supporting frame 34. The respective heads 32C, 32M, 32Y, and 32K attached to the head supporting frame 34 are arranged such that respect nozzle faces 36C, 36M, 36Y, and 36K are directed to the outer peripheral face of the transport drum 22, and are arranged at regular interval in the Y direction.

Additionally, the head supporting frame 34 is provided such that the positions of the respective heads 32C, 32M, 32Y, and 32K in a direction orthogonal to the outer peripheral face of the transport drum 22 are adjustable. Accordingly, in the respective heads 32C, 32M, 32Y, and 32K, the distance between the nozzle faces 36C, 36M, 36Y, and 36K and the outer peripheral face of the transport drum 22 is adjusted.

The heads 32C, 32M, 32Y, and 32K respectively jet cyan ink drops, magenta ink drops, yellow ink drops, and black ink drops, respectively from the nozzle faces 36C, 36M, 36Y, and 36K, respectively.

[Description of Head Moving Mechanism]

A head moving mechanism 202 horizontally moves the head unit 30 in the X direction orthogonal to the Y direction. The head moving mechanism 202 is configured to include, for example, a ceiling frame that is horizontally installed across the paper transport unit 20, a guide rail laid on the ceiling frame, a traveling body that slidingly moves on the guide rail, and drive means for moving the traveling body along the guide rail. As the drive means, for example, a feed screw mechanism or the like including a feed screw, a motor that rotationally drives the feed screw, and the like can be used. In the head unit 30, the head supporting frame 34 is attached to the traveling body, and slidingly moves horizontally.

The respective heads 32C, 32M, 32Y, and 32K provided in the head unit 30 move between an "image recording position" and a "maintenance position" in a case where the head unit 30 is driven by the head moving mechanism 202 and horizontally moved.

At the image recording position, the respective heads 32C, 32M, 32Y, and 32K provided in the head unit 30 face the paper transport unit 20. The paper P is transported along the outer peripheral face of the transport drum 22 by the paper transport unit 20. In a case where the paper P passes through positions that face the nozzle faces 36C, 36M, 36Y, and 36K of the respective heads 32C, 32M, 32Y, and 32K, ink drops are jetted toward the paper P from the respective nozzle faces 36C, 36M, 36Y, and 36K. Accordingly, an image is recorded on the paper P.

At the maintenance position, the respective heads 32C, 32M, 32Y, and 32K face the maintenance unit 40. For example, in a case where the device is stopped for a long time, the head unit 30 is moved at the maintenance position. The maintenance unit 40 respectively comprises the caps 42C, 42M, 42Y, and 42K that respectively cover the nozzle faces 36C, 36M, 36Y, and 36K of the respective heads 32C, 32M, 32Y, and 32K.

[Configuration of Maintenance Unit]

Since the configurations of the respective caps 42C, 42M, 42Y, and 42K are the same, the cap 42C will be representatively described herein.

Figure 10:
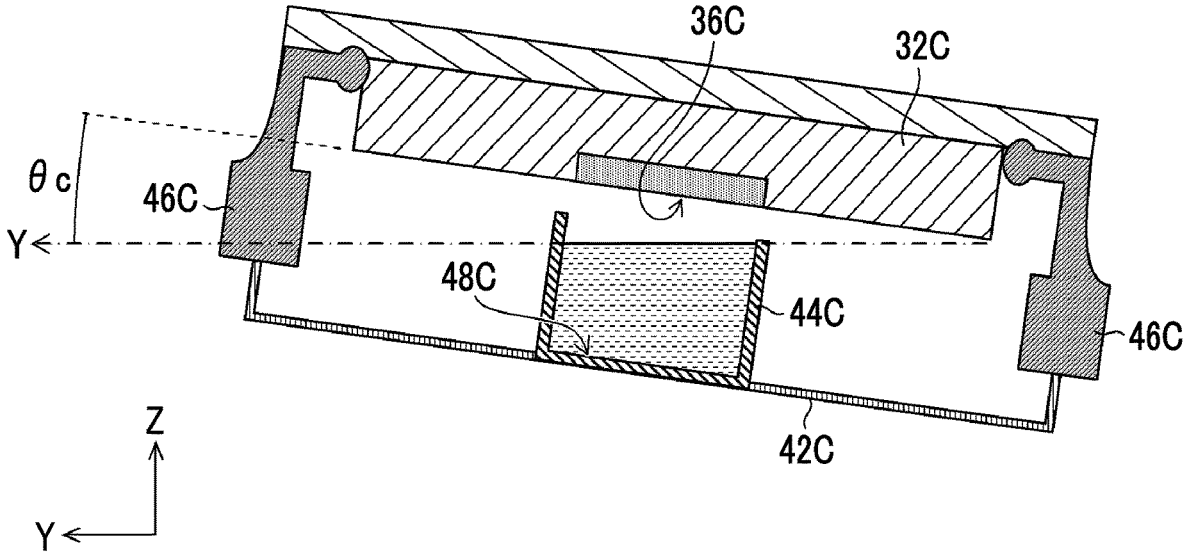
FIG. 10 is a 10-10 cross-sectional view of FIG. 7.

FIG. 10 is a 10-10 cross-sectional view of FIG. 7. The cap 42C has a box shape that includes a bottom face and four side faces and is open upward in a Z direction, and comprises a liquid chamber 44C that stores a moisturizing liquid, and a rubber blade 46C for sealing the nozzle face 36C of the head 32C within the cap 42C.

The moisturizing liquid for moisturizing the nozzle face 36C is stored in the liquid chamber 44C.

The nozzle face 36C of the head 32C is inclined in the Y direction by an angle $\theta_C$ with respect to the horizontal plane. Hence, the liquid level of the moisturizing liquid stored in the liquid chamber 44C, and the nozzle face 36C has an inclination by the angle $\theta_C$.

The rubber blade 46C is provided on the four side faces of the four quarters of the cap 42C, and abuts against the side faces of the head 32C to seal the nozzle face 36C of the head 32C inside the cap 42C.

In this way, at the maintenance position, the cap 42C, having the liquid chamber 44C that holds the moisturizing liquid on a lower side of the head 32C in a vertical direction (Z direction), is disposed to cover a gap between the cap 42C and the head 32C, and thereby, the nozzle face 36C is held in the sealed space of the cap 42C. Accordingly, the nozzle face 36C can be maintained at a high humidity by the moisture of the moisturizing liquid that evaporates from the liquid chamber 44C, and an increase in viscosity of the ink inside the nozzles 110 (refer to FIG. 3) can be prevented.

Additionally, since the temperature and humidity detector 122 for measuring the humidity equivalent to the humidity of the nozzle face 36C is disposed in the head 32C, it is possible to detect whether or the inside of the cap 42C is maintained at a humidity suitable for preventing drying of the head 32C.

In addition, it is desirable that the air intake ports 114A and 114B are immediately above the liquid level of the liquid chamber 44C in the vertical direction. This is because air enters or leaves the gap between the end face of the cap 42C and the head 32C and therefore, a humidity distribution in which a lower humidity is obtained nearer the end face of the cap 42C may be created.

Additionally, as illustrated in FIG. 7, a moisturizing liquid discharge port 52C is provided on one end side in the X direction in a bottom face 48C of the liquid chamber 44C, and a moisturizing liquid supply port 50C is provided on the other end side in the X direction. The moisturizing liquid is supplied into the liquid chamber 44C via the moisturizing liquid supply port 50C by a moisturizing liquid supply mechanism 204 (refer to FIG. 16). Additionally, the moisturizing liquid inside the liquid chamber 44C is discharged from the moisturizing liquid discharge port 52C.

In addition, the bottom face 48C of the liquid chamber 44C is inclined downward in the vertical direction toward the moisturizing liquid discharge port 52C. Accordingly, the moisturizing liquid can be appropriately discharged from the moisturizing liquid discharge port 52C.

In a case where the bottom face 48C has an inclination in this way, the temperature and humidity detector 122 is disposed at an end cap 108L on a side that faces a higher side (side where the moisturizing liquid is shallow) of the bottom face 48C in the vertical direction, out of the end caps 108L (left side in FIG. 7) and 108R (right side in FIG. 7) on both sides of the head 32C in the X direction. This is because, for example, in a case where the moisturizing liquid of the liquid chamber 44C is not replenished and the liquid chamber 44C is left for a long time or in a case where the amount of the moisturizing liquid inside the liquid chamber 44C decreases due to leakage failure of a tube of the moisturizing liquid supply mechanism 204, retreat of the liquid level of the moisturizing liquid is relatively fast, and the humidity is likely to be relatively low.

The head 32C performs so-called dummy jetting (preliminary discharge) in which ink is jetted to the liquid chamber 44C in a state where the nozzle face 36C is sealed within the cap 42C, as one of maintenance sequences for maintaining a jetting state. The dummy jetting can remove the viscosity-increased ink inside the respective nozzles 110 and prevent ink from sticking to the insides of the nozzles 110.

In addition, there is a case where ink mist is generated due to the dummy jetting, the generated ink mist floats inside the cap 42C, and adhere to the nozzle face 36C. However, since the air intake ports 114A and 114B of the nozzle face 36C and the detection face 122A of the temperature and humidity detector 122 are connected to each other by the detector connection passages 120A and 120B that are the bent paths, there is no case where the ink mist adheres to the detection face 122A of the temperature and humidity detector 122 and the detection face 122A is contaminated.

Here, in the detector connection passages 120A and 120B, one having a shorter flow passage length is excellent in the responsiveness of the temperature and humidity detection of the temperature and humidity detector 122. However, in a case where the flow passage length is too short, there is a concern that the ink mist adheres to the detection face 122A. Hence, it is desirable to take a long flow passage length in a range where a required responsiveness is kept. In the present embodiment, disposition with a long flow passage length is realized in a small space by adopting a structure in which the detector connection passages 120A and 120B are made to have a bent labyrinth structure instead of a linear structure.

Additionally, the cap 42C includes a pressurizing mechanism (not illustrated) for pressurizing the insides of the nozzles 110 of the head 32C to perform pressurization purge, and a suction mechanism (not illustrated) for suctioning the insides of the nozzles 110.

[Configuration of Nozzle Face Cleaning Unit]

As illustrated in FIGS. 7 and 8, the nozzle face cleaning unit 80 is installed between the image recording position and the maintenance position on a movement route of the head unit 30 by the head moving mechanism 202.

As illustrated in FIG. 8, the nozzle face cleaning unit 80 comprises wiping units 82C, 82M, 82Y, and 82K (examples of a wiping part). The wiping units 82C, 82M, 82Y, and 82K wipes the nozzle faces 36C, 36M, 36Y, and 36K, respectively, as one of the maintenance sequences for maintaining the jetting state in a case where the heads 32C, 32M, 32Y, and 32K move between the image recording position and the maintenance position.

Although the wiping unit 82C will be representatively described herein, the configurations of the respective wiping units 82C, 82M, 82Y, and 82K are the same.

As illustrated in FIG. 7, the wiping unit 82C comprises a wiping web 84C that wipes the nozzle face 36C, a supply shaft 86C that delivers the wiping web 84C, a winding shaft 88C that winds the wiping web 84C, and a pressing roller 90C that presses the nozzle face 36C against the wiping web 84C.

The wiping web 84C is formed of an elongated sheet material that is made of knitted or woven fabric using ultrafine fibers, such as polyethyleneterephthalate, polyethylene, nylon, and acrylic and have absorptivity. The width of the wiping web 84C corresponds to the width of the nozzle face 36C in the Y direction, that is, the width of the nozzle face 36C in a direction orthogonal to a movement direction of the head 32C. Here, the width of the wiping web 84C is the same as the width of the nozzle face 36C in the Y direction.

Additionally, the wiping web 84C absorbs a wiping liquid for cleaning the nozzle face 36C in advance and is brought into a wetted state, and the wiping unit 82C wipes the nozzle face 36C by the wetted wiping web 84C. In addition, the wiping liquid may be applied to the wiping web 84C in a dry state in a traveling route of the wiping web 84C to bring the wiping web 84C into a wet state, or the wiping liquid may be applied to the nozzle face 36C, and the nozzle face 36C to which the wiping liquid is applied may be wiped by the wiping web 84C in a dry state.

The supply shaft 86C is a horizontal shaft orthogonal to the movement direction of the head 32C, and is rotatably supported by a bearing (not illustrated). The winding shaft 88C is a horizontal shaft orthogonal to the movement direction of the head 32C, is rotatably supported by a bearing (not illustrated), and is rotationally driven clockwise in FIG. 7 by a motor (not illustrated).

The pressing roller 90C has a columnar shape. The length of the pressing roller 90C orthogonal to a radial direction of the pressing roller 90C is a length corresponding to the width of the wiping web 84C in the X direction, and the size of the pressing roller 90C in the radial direction can be appropriately determined. The pressing roller 90C is rotatably and vertically movably supported in a state where the pressing roller 90C is biased in a direction toward the nozzle face 36C. The wiping web 84C is wound around an upper peripheral face of the pressing roller 90C.

As the winding shaft 88C is rotationally driven, the wiping web 84C travels from the supply shaft 86C to the winding shaft 88C via the pressing roller 90C. Additionally, the pressing roller 90C is pressed against the nozzle face 36C of the head 32C.

The wiping unit 82C presses the traveling wiping web 84C against the nozzle face 36C of the head 32C moved in the X direction by the head moving mechanism 202, to wipe the nozzle face 36C.

[Operation of Nozzle Face Cleaning Unit]

Figure 11:
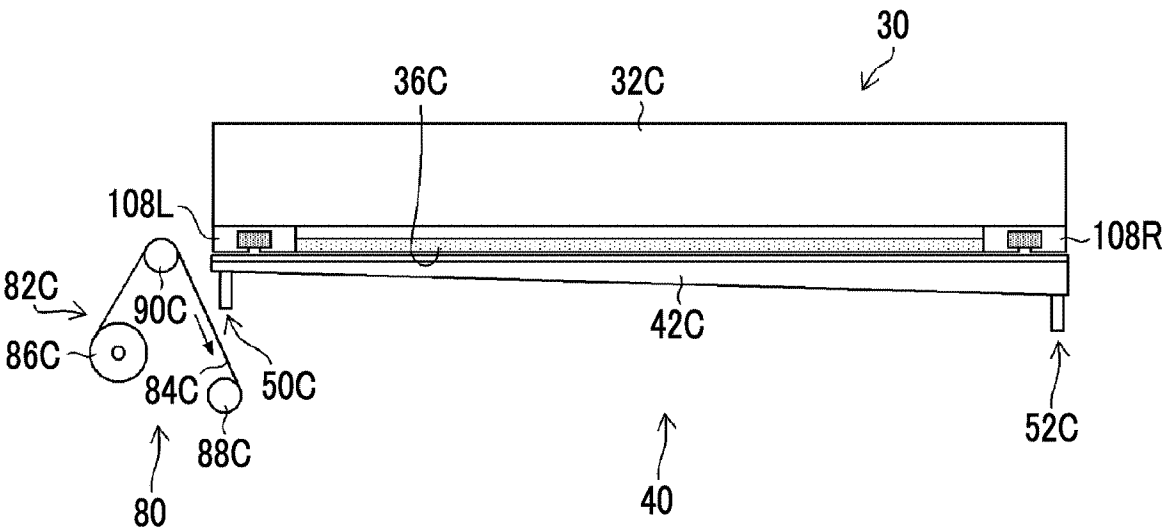
FIG. 11 is a view for explaining the operation of a nozzle face cleaning unit.
Figure 11:
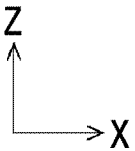
Figure 12:
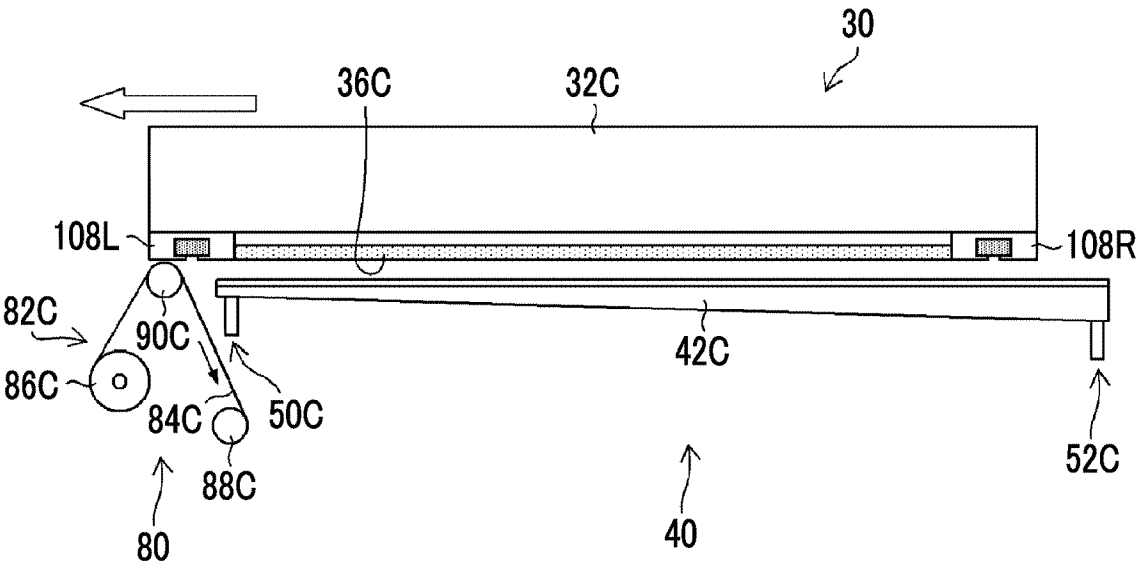
FIG. 12 is a view for explaining the operation of the nozzle face cleaning unit.
Figure 12:
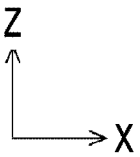
Figure 13:
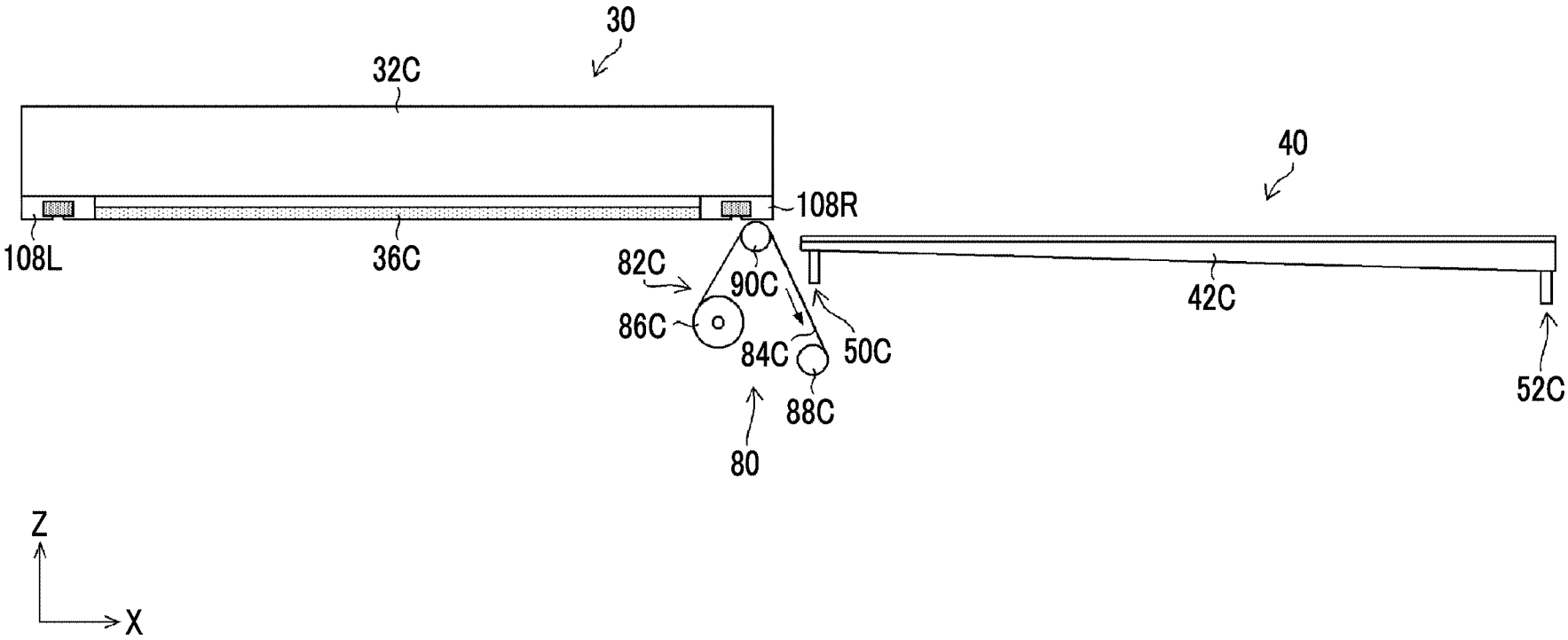
FIG. 13 is a view for explaining the operation of the nozzle face cleaning unit.

FIGS. 11 to 13 are views for explaining the operation of the nozzle face cleaning unit 80, and representatively illustrate the wiping unit 82C herein.

FIG. 11 illustrates a state where the head 32C is at the maintenance position and the nozzle face 36C is covered with the cap 42C. In this state, the head 32C can measure the humidity equivalent to the humidity of the nozzle face 36C by means of the temperature and humidity detector 122.

FIG. 12 is a view illustrating the start of wiping of the nozzle face 36C, and illustrates a state where the head unit 30 has started movement in a left direction in the drawing from the maintenance position by the head moving mechanism 202. The wiping unit 82C rotationally drives the winding shaft 88C to make the wiping web 84C travel. Then, as the head 32C is moved in the left direction in the drawing by the head moving mechanism 202, the surface 108A of the end cap 108L at one end of a lower face of the head 32C in the X direction abuts against the traveling wiping web 84C, and the surface 108A is wiped by the wiping web 84C.

As the head 32C is further moved in the left direction in the drawing from this state, the nozzle face 36C of the head 32C abuts against the traveling wiping web 84C, and the nozzle face 36C is wiped by the wiping web 84C.

FIG. 13 is a view illustrating a state immediately before the wiping of the nozzle face 36C is completed, and illustrates a state immediately before the movement of the head unit 30 in the left direction in the drawing is completed. The surface 108A of an end cap 108R at the other end of the lower face of the head 32C in the X direction abuts against the traveling wiping web 84C, and the surface 108A is wiped by the wiping web 84C.

Since the temperature and humidity detector 122 is disposed not on the same plane as the nozzle face 36C but inside the surface 108A of the end cap 108L that forms the same plane as the nozzle face 36C, the temperature and humidity detector 122 is not contaminated due to the wiping liquid resulting from the wiping of the wiping unit 82C, and the ink drawn out of the nozzles 110 during wiping. Hence, the temperature and humidity detector 122 can perform correct humidity detection without concern about degradation with the passage of time.

By using, for example, a member subjected to liquid-repelling treatment with electroless nickel containing Teflon (registered trademark) resin, or the like for the end cap 108L, adhesion of the ink and the wiping liquid to the end cap 108L can be prevented, and entering of the ink and the wiping liquid from the air intake ports 114A and 114B can be prevented.

<Second Embodiment>

[Configuration of Head]

Figure 14:
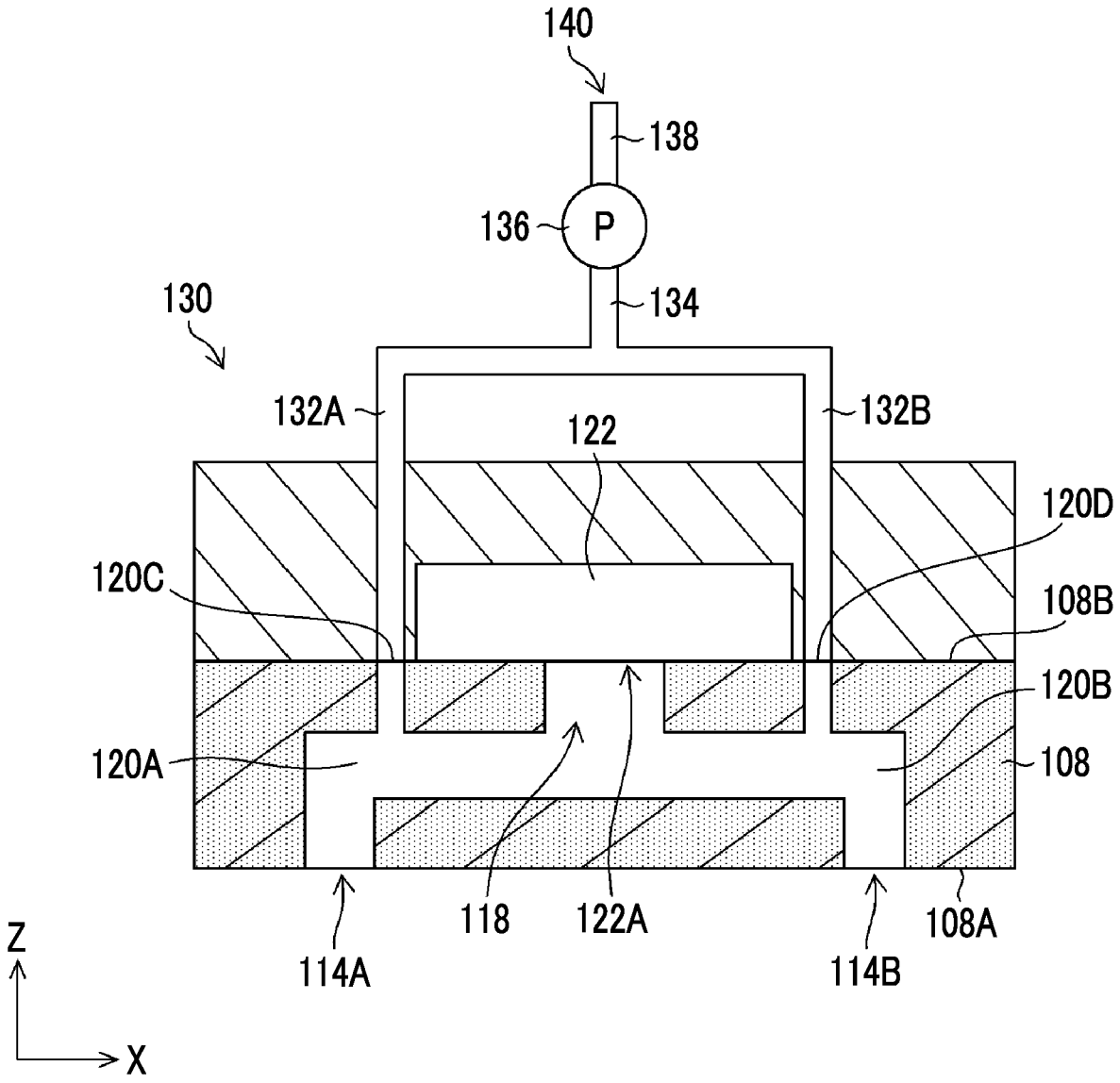
FIG. 14 is a schematic view illustrating a structure example in the vicinity of the end cap of the head.

FIG. 14 is a schematic view illustrating an example of a structure of an end cap 108 in the vicinity of a head 130 related to a second embodiment. In addition, the portions that are in common with those in the cross-sectional view illustrated in FIG. 5 will be designated by the same reference signs and the detailed description thereof will be omitted.

Figure 15:
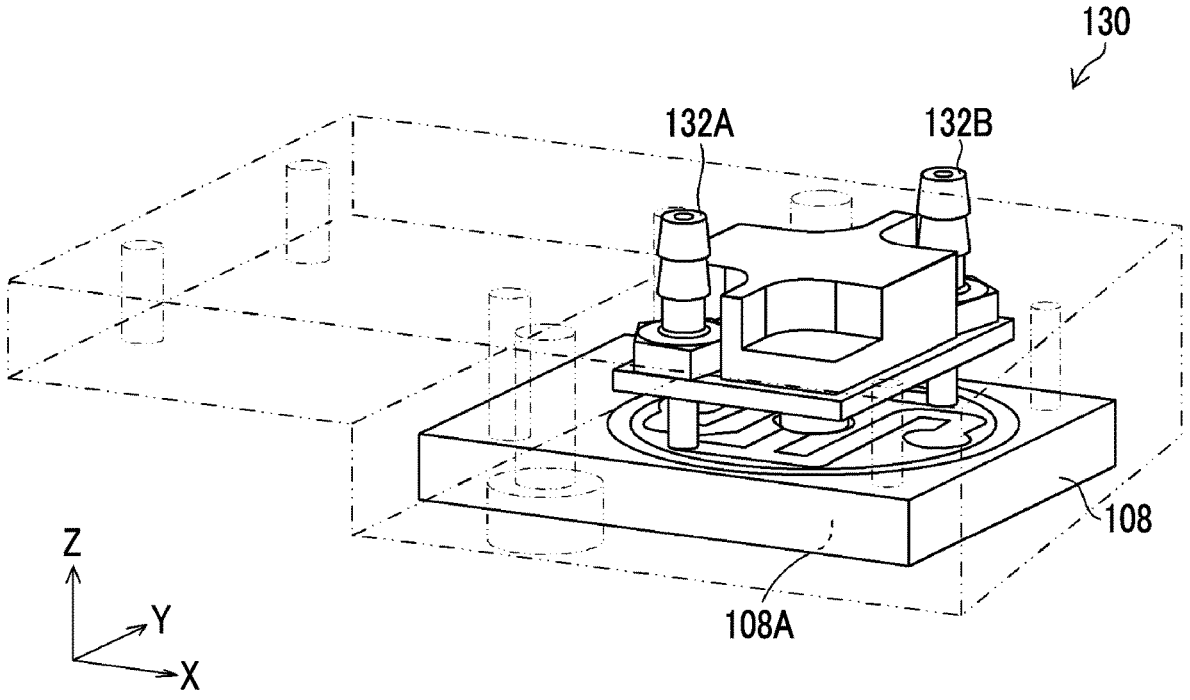
FIG. 15 is a perspective view viewed from a side opposite to a surface near the end cap of the head.

Additionally, FIG. 15 is a perspective view as seen from a side opposite to the surface 108A in the vicinity of the end cap 108 of the head 130.

The head 130 comprises an air introduction passage 132A having one end communicating with the blind passage part 120C of the detector connection passage 120A and the other end penetrates to a side opposite to the nozzle face 102 of the head 130, an air introduction passage 132B having one end communicating with the blind passage part 120D of the detector connection passage 120B and the other end penetrating to the side opposite to the nozzle face 102, a pump connection passage 134 communicating the air introduction passage 132A and the air introduction passage 132B, an air pump 136, a pump intake pipe 138, and an intake port 140.

In addition, positions where the air introduction passage 132A and the air introduction passage 132B communicate with the detector connection passage 120A and the detector connection passage 120B are not limited to the blind passage part 120C and the blind passage part 120D.

Additionally, illustration of the pump connection passage 134, the air pump 136, the pump intake pipe 138, and the intake port 140 is omitted in FIG. 15.

The air pump 136 is air supply means for supplying the ambient air taken into the pump connection passage 134 from the intake port 140 of the pump intake pipe 138.

The air pump 136 pressurizes the insides of the detector connection passages 120A and 120B via the pump connection passage 134 and the air introduction passages 132A and 132B by the ambient air taken in from the intake port 140 at least during the dummy jetting of the head 130 and the wiping of the nozzle face 102, and discharges the air from the air intake ports 114A and 114B. Accordingly, the air pump 136 functions as the contamination preventing part that prevents the detection face 122A of the temperature and humidity detector 122 from being contaminated. Additionally, the air pump 136 enables high-accuracy detection that does not affect the humidity detection due to the adhesion of the ink mist to the insides of the detector connection passages 120A and 120B and the adhesion of the wiping liquid.

In addition, the air pump 136 may prevent the entering of the ink mist from the air intake ports 114A and 114B, the entering of the ink drawn out of the nozzles 110, and the entering of the wiping liquid. Hence, it is also possible to use minute-flow-rate micro pumps that may have minute air flow rate and are formed of MEMS (Micro Electro-Mechanical Systems).

Additionally, even in a case where there is no entering of the wiping liquid or the like, in a case where the wiping liquid or the like adheres around the air intake ports 114A and 114B, there is a case where the adhering wiping liquid or the like evaporates, and thereby, a humidity higher than the humidity in the vicinity of the nozzle face 102 may be detected for a while after the wiping.

In order to prevent this, the air pump 136 is operated by a preset time after the wiping to continue discharging air, and the wiping liquid adhering around the air intake ports 114A and 114B is evaporated. Accordingly, the humidity in the vicinity of the nozzle face 102 can be detected inside the cap 42C without being influenced by disturbance of humidity fluctuation resulting from the wiping after the stop of the air pump 136.

Here, although the two air introduction passages 132A and 132B are provided from the air pump 136 to the detector connection passages 120A and 120B to allow the communication therebetween, an aspect in which only any one introduction passage is provided is also possible.

[Electrical Configuration]

Figure 16:
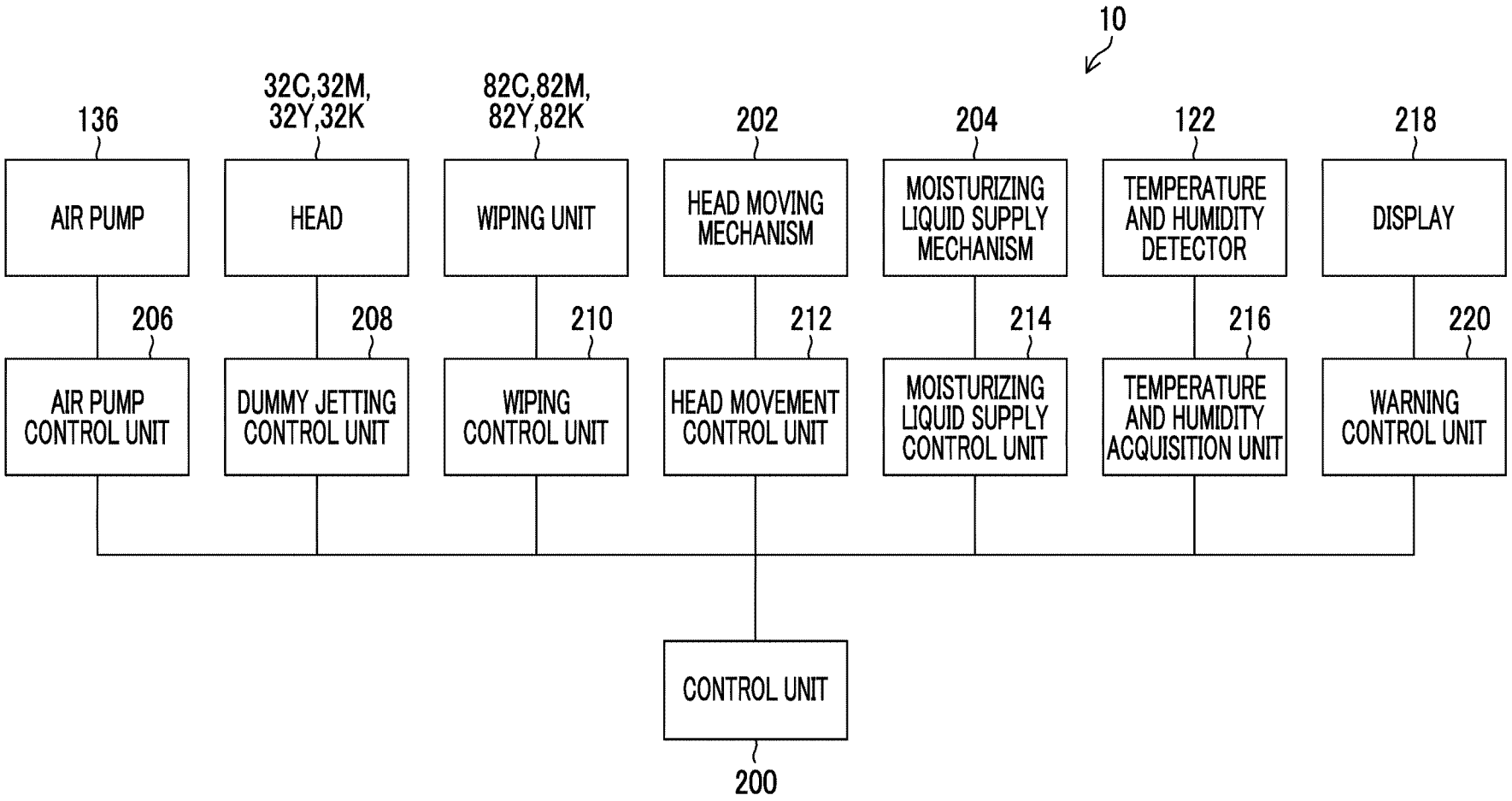
FIG. 16 is a block diagram of the ink jet recording device.

FIG. 16 is a block diagram of the ink jet recording device 10, and illustrates only portions relevant to the temperature and humidity detector 122. As illustrated in this drawing, the ink jet recording device 10 comprises a control unit 200, an air pump control unit 206, a dummy jetting control unit 208, a wiping control unit 210, a head movement control unit 212, a moisturizing liquid supply control unit 214, a temperature and humidity acquisition unit 216, a display 218, and a warning control unit 220, in addition to the aforementioned heads 32C, 32M, 32Y, and 32K, wiping unit 82C, 82M, 82Y and 82K, temperature and humidity detector 122, air pump 136, head moving mechanism 202, and moisturizing liquid supply mechanism 204.

The control unit 200 integrally controls the respective units of the ink jet recording device 10.

The air pump control unit 206 controls driving of the air pump 136 to control the presence or absence of discharge of air from the air intake ports 114A and 114B.

The dummy jetting control unit 208 controls the heads 32C, 32M, 32Y, and 32K at the maintenance position, and performs the dummy jetting from the respective nozzles 110.

The wiping control unit 210 controls the wiping units 82C, 82M, 82Y, and 82K and makes the wiping webs 84C, 84M, 84Y, and 84K travel (to refer to FIG. 7).

The head movement control unit 212 controls the head moving mechanism 202, and control the movement of the head unit 30 in the X direction.

The moisturizing liquid supply control unit 214 controls the moisturizing liquid supply mechanism 204, and controls the presence or absence of supply of the moisturizing liquid to the liquid chambers 44C, 44M, 44Y, and 44K and the amount of supply of the moisturizing liquid (refer to FIG. 8).

The temperature and humidity acquisition unit 216 controls the temperature and humidity detector 122, and acquires the temperature and the humidity detected by the temperature and humidity detector 122.

The display 218 is display means, such as a liquid crystal display monitor, and the warning control unit 220 displays warning for a user on the display 218 on the basis of the temperature and the humidity detected by the temperature and humidity acquisition unit 216.

[Example of Measurement of Humidity]

Figure 17:
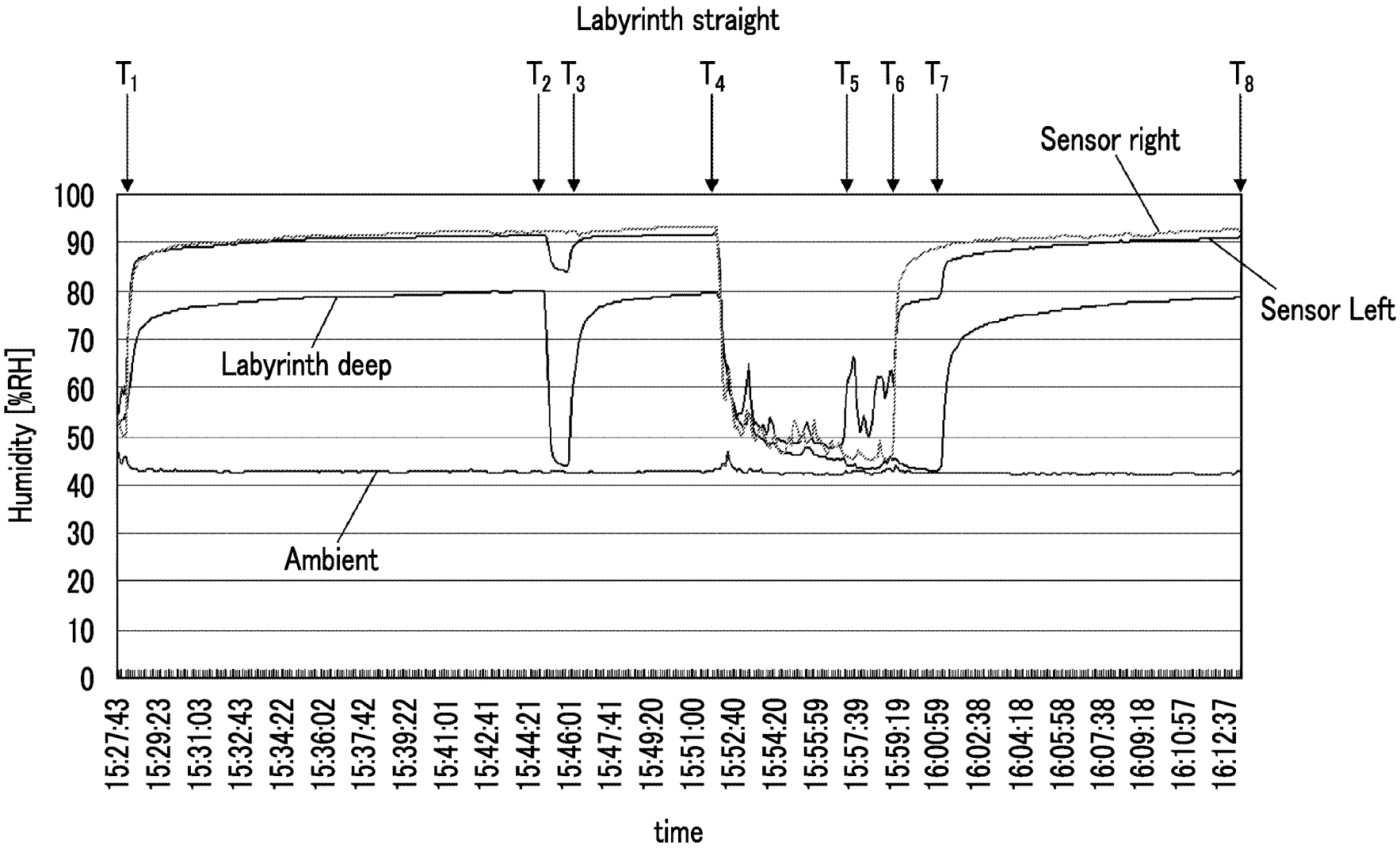
FIG. 17 is a graph illustrating the humidity detected by a temperature and humidity detector.

FIG. 17 is a graph illustrating the humidity "Labyrinth deep" detected by the temperature and humidity detector 122 of the head 32C to which the head 130 of the ink jet recording device 10 is applied, a horizontal axis represents time and a vertical axis represent the humidity (unit: % RH (Relative Humidity)). The temperature and humidity detector 122 of the head 32C is disposed inside the end cap 108L. In addition, in FIG. 17, in addition to the humidity detected by the temperature and humidity detector 122, the humidity of the nozzle face 36C close to the end cap 108L is indicated as "Sensor left", the humidity of the nozzle face 36C close to the end cap 108R is indicated as "Sensor right", and the ambient humidity of the ink jet recording device 10 is indicated as "Ambient". The "Sensor left", the "Sensor right", and the "Ambient" are respectively results obtained by being measured by humidity detectors different from the temperature and humidity detector 122.

Here, the nozzle face 36C is sealed by the cap 42C at time $T_1$, the discharge of air from the air intake ports 114A and 114B by the air pump 136 is started at time $T_2$, and the discharge of air is stopped at time $T_3$.

Additionally, the sealing of the nozzle face 36C by the cap 42C is released at time $T_4$, and the discharge of air from the air intake ports 114A and 114B by the air pump 136 is started at time $T_5$.

Moreover, the nozzle face 36C of the head 32C is sealed by the cap 42C at time $T_6$, the discharge of air from the air intake ports 114A and 114B by the air pump 136 is stopped at time $T_7$, this state is maintained, and the humidity is detected till time $T_8$.

At times $T_1$ to $T_8$, the ambient humidity (Ambient) of the ink jet recording device 10 is stable at about RH 40%.

Additionally, since the temperature and humidity detector 122 is not disposed on the same plane as the surface 108A of the end cap 108, the humidity detected by the temperature and humidity detector 122 related to the present embodiment indicates a humidity slightly lower than the humidity of the nozzle face 36C. In the example illustrated in FIG. 17, at times $T_1$ to $T_2$ during which the nozzle face 36C is in a sealed state by the cap 42C, the humidities (Sensor left and Sensor right) of the nozzle face 36C in the vicinity of the end caps 108L and 108R are about 90% RH, whereas the detection value (Labyrinth deep) of the temperature and humidity detector 122 is equal to or lower than 80% RH that is about 10% RH lower than the above 90% RH.

However, at the sealing start at time $T_1$ and the sealing end at time $T_4$, the detection value (Labyrinth deep) of the temperature and humidity detector 122 and the humidities (Sensor left and Sensor right) of the nozzle face 36C in the vicinity of the end caps 108L and 108R show similar response characteristics. Therefore, by setting a threshold value in consideration of an offset amount in advance, it is possible to determine whether or not the humidity inside the cap 42C is in a normal state.

Hence, in a case where the humidity inside the cap 42C is lower than a normal value, at least one of the sequences of performing warning of warning display or the like to the display 218 for a user, performing the replenishment of the moisturizing liquid in the liquid chamber 44C and the moisturizing liquid replacement sequence, performing the dummy jetting in the head 32C, and performing the wiping of the nozzle face 36C is executed. Accordingly, it is possible to prevent that a state where the humidity is abnormal is continued and the head 32C is dried.

Additionally, in a case where the temperature and the humidity inside the cap 42C are higher than normal such that dew condensates on the nozzle face 36C, for example, at least one of the sequences of moves the head 32C from the maintenance position, operating an in-device fan (not illustrated) of the ink jet recording device 10, and driving the air pump 136 is executed. Accordingly, it is possible to keep the humidity of the nozzle face 36C in an appropriate state.

Figure 18:
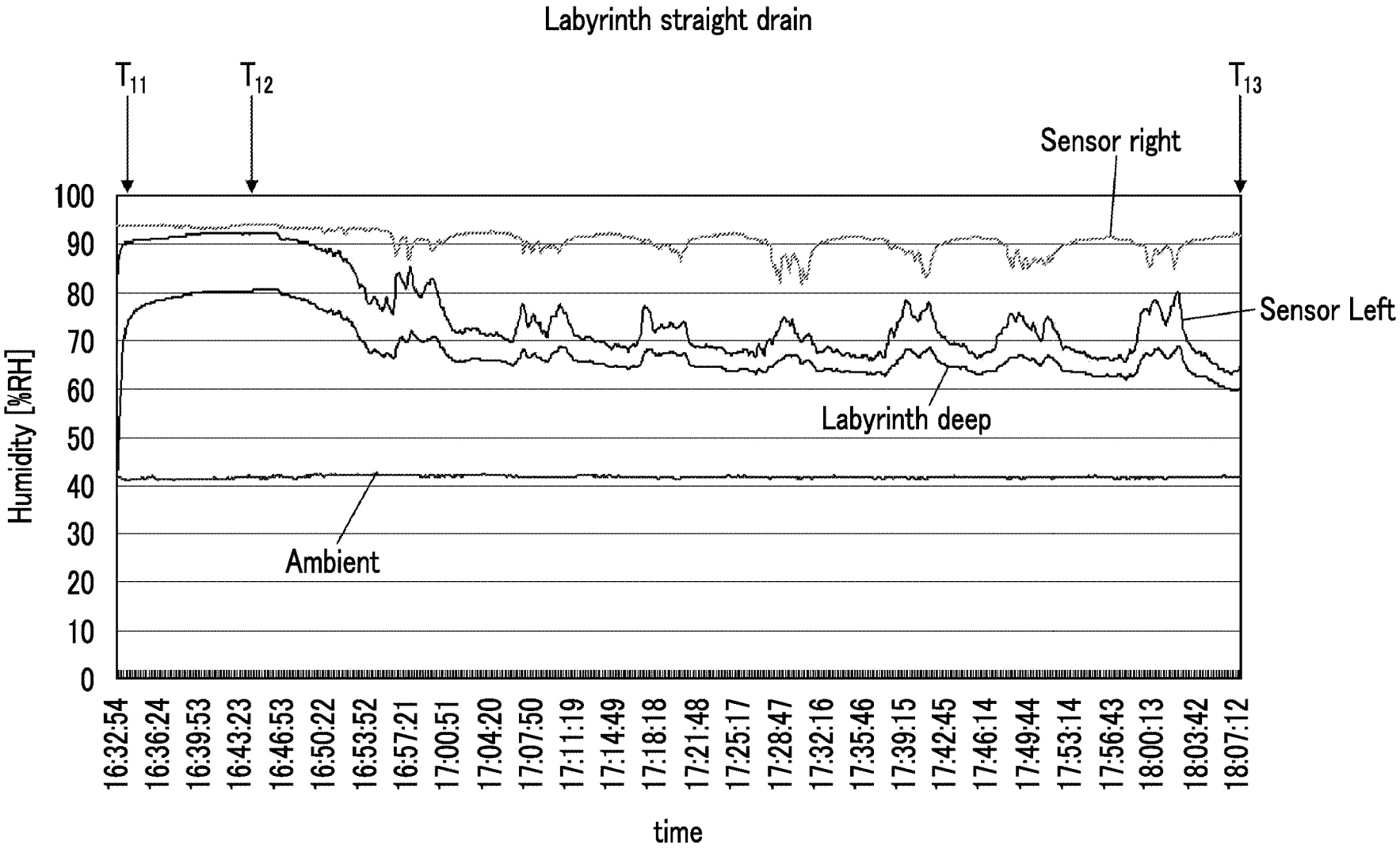
FIG. 18 is a graph illustrating the humidity detected by the temperature and humidity detector.

FIG. 18 is a graph illustrating the humidity (Labyrinth deep) detected by the temperature and humidity detector 122 of the head 32C similarly to FIG. 17.

Here, in a state where the nozzle face 36C is sealed by the cap 42C, the discharge of air from the air intake ports 114A and 114B by the air pump 136 is stopped at time $T_{11}$, and the discharge of the moisturizing liquid through the moisturizing liquid discharge port 52C from the liquid chamber 44C is started at time $T_{12}$. The discharge of the moisturizing liquid is substantially completed in about 10 minutes after time $T_{12}$, and humidity detection is performed till time $T_{13}$.

Although the humidities (Sensor left and Sensor right) of the end cap 108L and the nozzle face 36C in the vicinity of the 108R is equal to or more than 90% RH at time $T_{11}$ to $T_{12}$, the humidity (Sensor left) of the nozzle face 36C in the vicinity of the end cap 108L that is a high side of the bottom face 48C in the vertical direction becomes equal to or less than 80% RH after the lapse of about 10 minute from time $T_{12}$ when the discharge of the moisturizing liquid is started.

Along with this, since the detection humidity (Labyrinth deep) of the temperature and humidity detector 122 varies 10% RH or more from about 80% RH to about 70% RH, it can be seen that a humidity decrease resulting from a decrease in the liquid level of the liquid chamber 44C can be detected by the temperature and humidity detector 122.

Additionally, the humidity (Sensor right) of the nozzle face 36C in the vicinity of the end cap 108R that is a low side of the bottom face 48C in the vertical direction hardly decreases during about 10 minutes after time $T_{12}$ where the discharge of the moisturizing liquid is started is maintained at 90% RH or more. Therefore, it can be seen that, even in a case where the temperature and humidity detector 122 is disposed inside the end cap 108R on the low side of the bottom face 48C in the low vertical direction, a decrease in humidity resulting from a decrease in the liquid level of the moisturizing liquid cannot be detected. This result shows that it is effective to dispose the temperature and humidity detector 122 on the low side of the bottom face 48C in the vertical direction in a case where only one temperature and humidity detector 122 is disposed.

Figure 19:
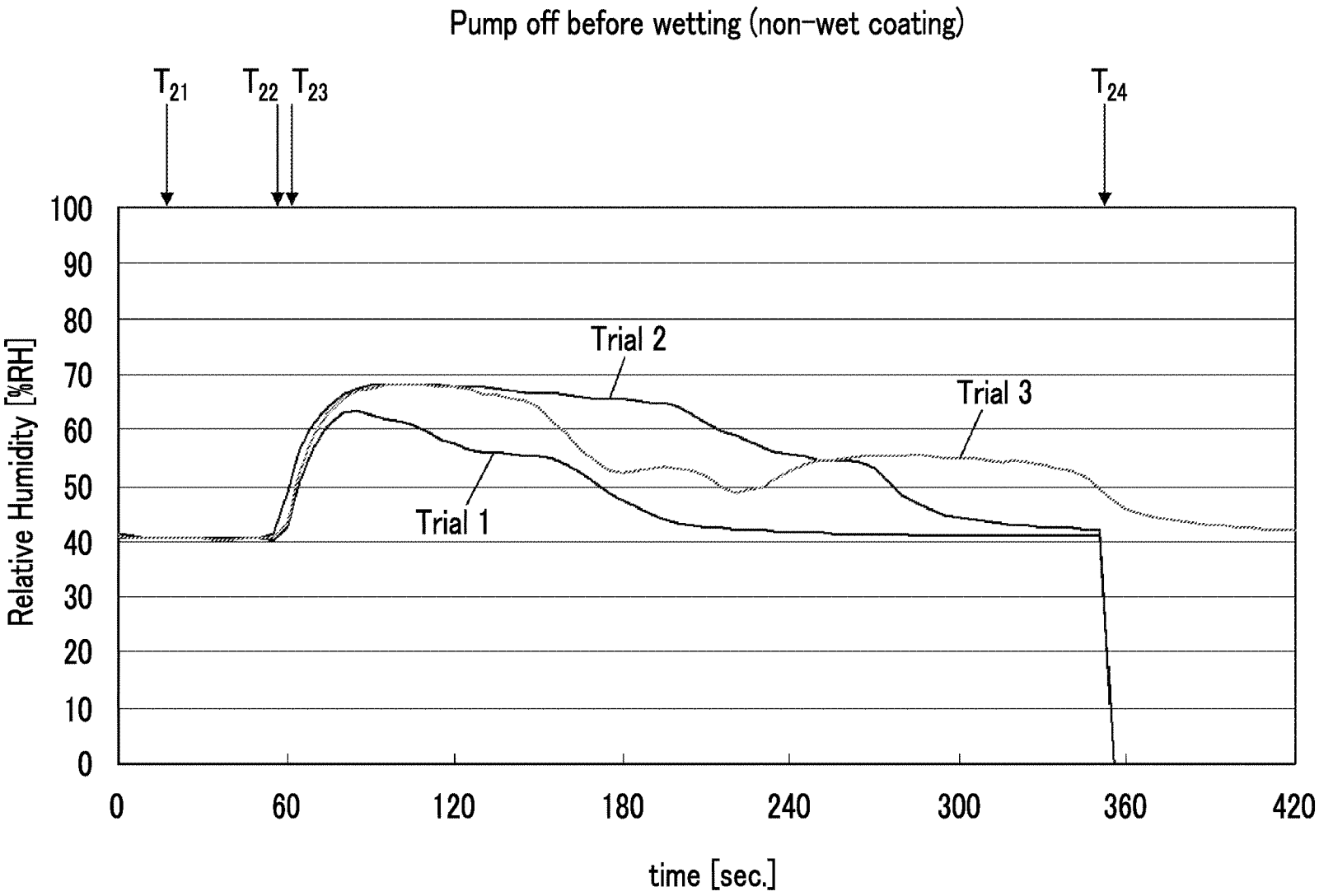
FIG. 19 is a graph illustrating the humidity detected by the temperature and humidity detector.
Figure 20:
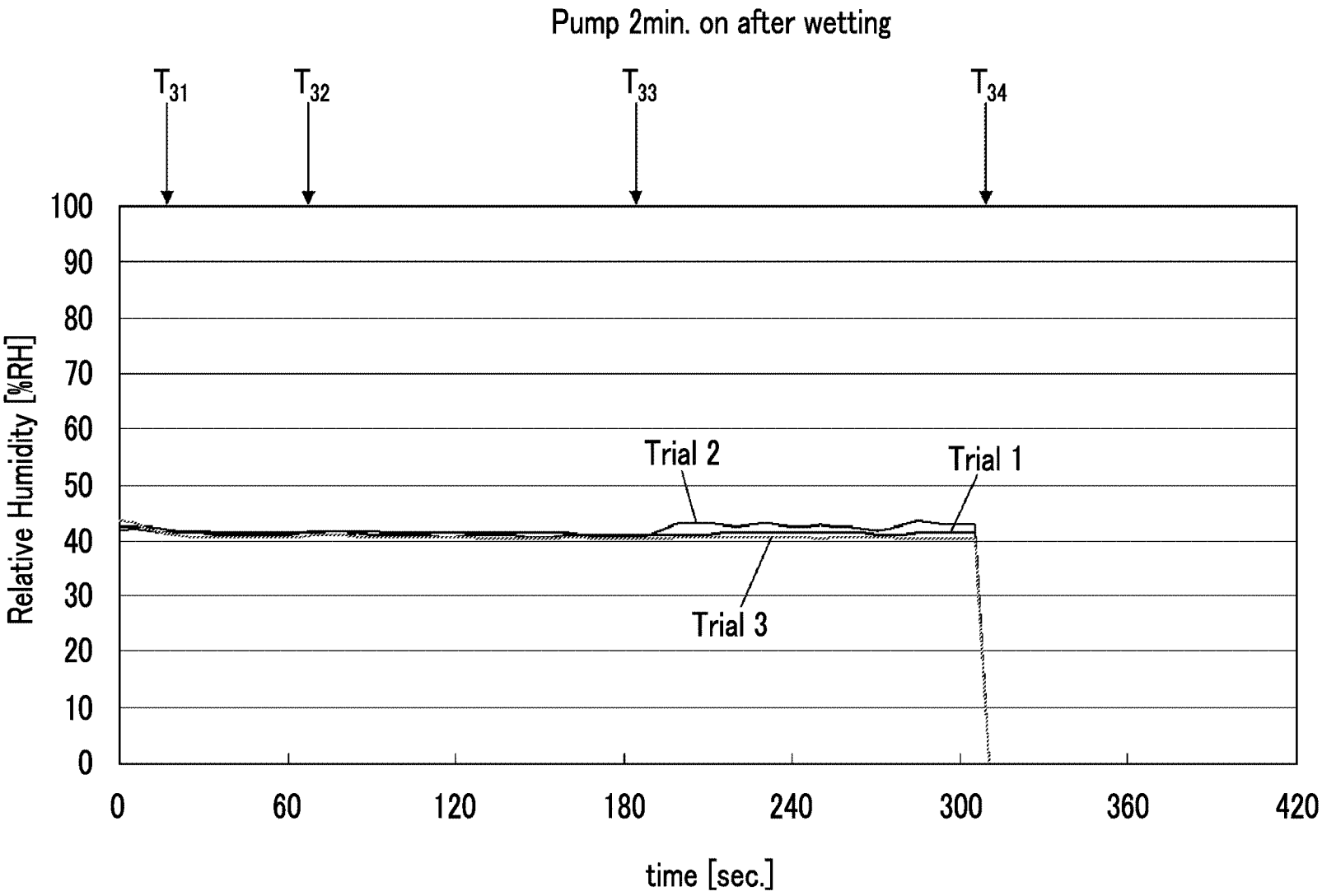
FIG. 20 is a graph illustrating the humidity detected by the temperature and humidity detector.

FIGS. 19 and 20 are graphs illustrating the humidity (Labyrinth deep) detected by the temperature and humidity detector 122 of the head 32C in a case where the nozzle face 36C is wiped by the wiping unit 82C, a horizontal axis represents elapsed time and a vertical axis represent the humidity (unit: % RH (Relative Humidity)). Here, the measurement is repeated three times, Trial 1, Trial 2, and Trial 3 illustrated in the drawing indicate first, second, third measurement results, respectively.

In a case illustrated in FIG. 19, the discharge of air from the air intake ports 114A and 114B by the air pump 136 is started at time $T_{21}$, the discharge of air is stopped at time $T_{22}$, and the wiping is performed at time $T_{23}$. Thereafter, the humidity detection is performed till time $T_{24}$.

In this case, the humidity (Labyrinth deep) detected by the temperature and humidity detector 122 increases in all the three measurements until the lapse of 3 to 6 minutes from time $T_{23}$ from when the wiping is performed. It is considered this is due to the adhesion of a cleaning liquid and the ink around the surface 108A of the end cap 108L and the air intake ports 114A and 114B.

Meanwhile, in a case illustrated in FIG. 20, the discharge of air from the air intake ports 114A and 114B by the air pump 136 is started at time $T_{31}$, the wiping is performed at time $T_{32}$, and the discharge of air is stopped at time $T_{33}$ that is 2 minutes after time $T_{32}$. Thereafter, the humidity detection is performed till time $T_{34}$. That is, the air pump 136 is driven during the wiping of the nozzle face 36C.

In this case, no increase in humidity is seen in all the three measurements. It is estimated that the entering of the cleaning liquid and the ink liquid in the air intake ports 114A and 114B is prevented due to the discharge of air by the air pump 136 and a slight amount of cleaning liquid and ink that adhere around the air intake ports 114A and 114B is also dried by the air to be discharged.

In this way, even in a case where the nozzle face 36C is wiped as the air pump 136 starting the discharge of air before the wiping of the nozzle face 36C by the wiping unit 82C and ends the discharge of air after the wiping is ended, high detection accuracy by the temperature and humidity detector 122 can be maintained.

Similarly, even in a case where the dummy jetting is performed in the head 32C, the air pump 136 starts the discharge of air before the dummy jetting and ends the discharge of air after the dummy jetting is ended. Accordingly, the entering of the ink mist in the air intake ports 114A and 114B can be prevented due to the discharge of air by the air pump 136, and the high detection accuracy by the temperature and humidity detector 122 can be maintained.

In addition, in a case where the discharge of air is performed using the air pump 136, labyrinth passages in which the detector connection passages 120A and 120B are connected to each other by the bent paths may not be configured.

Although the head 32C has been described herein, the same applied to the heads 32M, 32Y, and 32K.

As described above, the temperature and humidity detector can be prevented from being contaminated by disposing the temperature and humidity detector inside a member having the air intake port in the same plane as the nozzle face and connecting the air intake port and the temperature and humidity detector to each other by the bent paths.

Additionally, by discharging air from the air intake port by the air pump, the temperature and humidity detector can be prevented from being contaminated.

[Others]

The technical scope of the invention is not limited to the range described in the above embodiments. The components in the respective embodiments can be appropriately combined together between the respective embodiments without departing from the scope of the invention.

EXPLANATION OF REFERENCES

10: ink jet recording device
20: paper transport unit
22: transport drum
30: head unit
32C: head
32M: head
32Y: head
32K: head
34: head supporting frame
36C: nozzle face
36M: nozzle face
36Y: nozzle face
36K: nozzle face
40: maintenance unit
42C: cap
42K: cap
42M: cap
42Y: cap
44C: liquid chamber
44M: liquid chamber
44Y: liquid chamber
46C: rubber blade
48C: bottom face
50C: moisturizing liquid supply port
52C: moisturizing liquid discharge port
80: nozzle face cleaning unit
82C: wiping unit
82M: wiping unit
82Y: wiping unit
82K: wiping unit
84C: wiping web
86C: supply shaft
88C: winding shaft
90C: pressing roller
100: ink jet head (head)
102: nozzle face
104: head module
104-*i*: head module
106: head module supporting member
106A: surface
108: end cap
108A: surface
108B: back face
108L: end cap

108R: end cap
110: nozzle
114A: air intake port
114B: air intake port
118: recess part
120A: detector connection passage
120B: detector connection passage
120C: blind passage part
120D: blind passage part
122: temperature and humidity detector
122A: detection face
130: head
132A: air introduction passage
132B: air introduction passage
134: pump connection passage
136: air pump
138: pump intake pipe
140: intake port
200: control unit
202: head moving mechanism
204: moisturizing liquid supply mechanism
206: air pump control unit
208: dummy jetting control unit
210: wiping control unit
212: head movement control unit
214: moisturizing liquid supply control unit
216: temperature and humidity acquisition unit
218: display
220: warning control unit
P: paper

What is claimed is:

1. A liquid jetting head comprising:
a nozzle that jets a liquid;
a humidity sensor that is disposed further inside than the nozzle face where the nozzle is disposed;
a plurality of air intake ports that are disposed on the same plane as the nozzle face;
a plurality of connection passages that allow the plurality of air intake ports and the humidity sensor to communicate with each other, respectively; and
a contamination preventing part that prevents contamination of the humidity sensor.

2. The liquid jetting head according to claim 1,
wherein liquid-repelling treatment is performed on a member that forms the plurality of air intake ports.

3. The liquid jetting head according to claim 1,
wherein the humidity sensor is a temperature and humidity sensor that measures temperature and humidity.

4. The liquid jetting head according to claim 1,
wherein the humidity sensor is an electrostatic capacitive semiconductor sensor that detects a change in humidity as a change in electrostatic capacity between a pair of electrodes.

5. The liquid jetting head according to claim 1,
wherein the contamination preventing part are nonlinear connection passages that connect the plurality of the air intake ports and the humidity sensor to each other by bent paths.

6. The liquid jetting head according to claim 1,
wherein the contamination preventing part has an air introduction passage that communicates with the plurality of connection passages, and an air pump that pressurizes an inside of the plurality of connection passages via the air introduction passage.

7. A liquid jetting device comprising:
the liquid jetting head according to claim 6; and
a wiping part that wipes the nozzle face.

8. The liquid jetting device according to claim 7,
wherein the air pump starts the pressurizing of the plurality of connection passages before the wiping part wipes the nozzle face, and ends the pressurizing after the wiping part wipes the nozzle face.

9. A liquid jetting device comprising:
the liquid jetting head according to claim 6;
a cap that holds a moisturizing liquid and covers the nozzle face; and
a dummy jetting control unit that dummy-jets the liquid from the nozzle in a state where the nozzle face is covered with the cap.

10. The liquid jetting device according to claim 9,
wherein the air pump starts the pressurizing of the plurality of connection passages before the dummy jetting control unit dummy-jets the liquid, and ends the pressurizing of the plurality of connection passages after the dummy jetting control unit dummy-jets the liquid.

11. The liquid jetting device according to claim 9,
wherein the liquid jetting head has an elongated bar shape that extends in a first direction,
wherein the cap has a discharge port disposed on one end side of a bottom face in the first direction, and the bottom face is inclined downward in a vertical direction toward the discharge port, and
wherein the plurality of air intake ports are disposed on the other end side opposite to the one end side in the first direction.

12. A liquid jetting head comprising:
a nozzle that jets a liquid;
a humidity sensor that is disposed further inside than the nozzle face where the nozzle is disposed;
a plurality of air intake ports that are disposed on the same plane as the nozzle face; and
a contamination preventing part that prevents contamination of the humidity sensor, the contamination preventing part having a plurality of connection passages that allow the plurality of air intake ports and the humidity sensor to communicate with each other.

13. A liquid jetting device comprising:
the liquid jetting head according to claim 12; and
a wiping part that wipes the nozzle face,
wherein the contamination preventing part has an air introduction passage that communicates with the plurality of connection passages, and an air pump that pressurizes an inside of the plurality of connection passages via the air introduction passage.

14. A liquid jetting device comprising:
the liquid jetting head according to claim 12;
a cap that holds a moisturizing liquid and covers the nozzle face; and
a dummy jetting control unit that dummy-jets the liquid from the nozzle in a state where the nozzle face is covered with the cap,
wherein the contamination preventing part has an air introduction passage that communicates with the plurality of connection passages, and an air pump that pressurizes an inside of the plurality of connection passages via the air introduction passage.

* * * * *